US010274282B2

(12) United States Patent
Derus

(10) Patent No.: US 10,274,282 B2
(45) Date of Patent: Apr. 30, 2019

(54) ARCHERY DRAW STOP SYSTEM AND METHOD

(71) Applicant: Perfect Form Manufacturing LLC, West Henrietta, NY (US)

(72) Inventor: Michael W. Derus, Victor, NY (US)

(73) Assignee: Perfect Form Manufacturing LLC, West Henrietta, NY (US)

( * ) Notice: Subject to any disclaimer, the term of this patent is extended or adjusted under 35 U.S.C. 154(b) by 0 days.

(21) Appl. No.: 15/867,156

(22) Filed: Jan. 10, 2018

(65) Prior Publication Data

US 2018/0195829 A1 Jul. 12, 2018

Related U.S. Application Data

(60) Provisional application No. 62/444,529, filed on Jan. 10, 2017.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/105* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 7,305,979 | B1 * | 12/2007 | Yehle | F41B 5/10 124/25.6 |
| 8,544,456 | B2 * | 10/2013 | Grace | F41B 5/10 124/23.1 |
| 8,671,925 | B2 | 3/2014 | Grace | |
| 9,121,658 | B1 * | 9/2015 | Darlington | F41B 5/123 |
| 9,146,070 | B2 * | 9/2015 | Langley | F41B 5/1434 |
| 9,885,535 | B2 | 2/2018 | Evans | |
| 9,909,831 | B2 | 3/2018 | McPherson | |
| 2015/0345890 | A1 * | 12/2015 | McPherson | F41B 5/105 124/25.6 |
| 2017/0115088 | A1 * | 4/2017 | Grace | F41B 5/105 |
| 2018/0051957 | A1 | 2/2018 | Houle | |

* cited by examiner

*Primary Examiner* — John Ricci
(74) *Attorney, Agent, or Firm* — Barclay Damon LLP

(57) ABSTRACT

An archery draw stop system and method are disclosed herein. The archery draw stop system, in an embodiment, includes a limb engager configured to be mounted to a limb portion of a limb of an archery bow. The archery draw stop system also has a draw stopper portion configured to engage a member that is coupled to a rotary of the archery bow.

20 Claims, 24 Drawing Sheets

ARCHERY DRAW STOP SYSTEM AND METHOD

CROSS-REFERENCE TO RELATED APPLICATION

This application is a non-provisional of, and claims the benefit and priority of, U.S. Provisional Patent Application No. 62/444,529 filed on Jan. 10, 2017. The entire contents of such application are hereby incorporated by reference.

BACKGROUND

Cams have been used on compound bows for some time. Cam assemblies are designed to yield efficient energy transfer from the bow to the arrow. Some compound bows have opposing limbs, extending from a handle portion, that support the cam assemblies. Typically, each cam assembly is rotatably mounted on an axle which is then mounted on the applicable limb of the bow. Compound bows have a bowstring attached to the cam which sits in a track and also, typically, two power cables that each sit in a track on a separate module of the cam. The power cables are anchored to the cam, a limb or an axle. When the bowstring is pulled to full draw position, the cam is rotated, and the power cables are "taken up" on their respective ends to increase energy stored in the bow for later transfer, with the opposing ends "let out" to provide some give in the power cable.

Most compound bows are outfitted with either single cam systems or dual cam systems, and are set to accommodate a specific draw length for a given user. The draw length can be determined as the distance at full draw between the nocking point of the arrow on the bowstring to the back of the handle grip on the bow. Each user can customize the user's particular draw length to accommodate the user's unique arm span, body size and shooting preferences.

Some cam assemblies include a cam-mounted draw stop (e.g., a pin stop) that provides a stopping location in the draw cycle of the bowstring. The stopping location is intended to correspond to the user's predetermined draw length so that the user does not retract the bowstring beyond the predetermined draw length.

This known cam-mounted draw stop is designed to be directly fastened to the cam. As the cam rotates, the cam-mounted draw stop contacts the applicable limb, causing the cam to stop rotating. Certain cam-mounted draw stops can be repositioned on the cam to adjust the draw length setting. In such design, the cam defines an arc-shaped slot, and the user can slide the cam-mounted draw stop in such slot until reaching a desired position.

However, relying entirely upon these cam-mounted draw stops can have several disadvantages. For example, it can be difficult to control micro or fine adjustments of the cam-mounted draw stop in such arc-shaped slot. In addition, the collision of the cam-mounted draw stop with the limb surface can damage or otherwise induce wear on the surface of the limb.

The foregoing background describes some, but not necessarily all, of the problems, disadvantages and shortcomings related to the known draw stop approaches for archery bows.

SUMMARY

In an embodiment, the archery draw stop system includes a body having a limb engager configured to be mounted to a limb portion of a limb of an archery bow. The limb engager defines an opening, and the limb portion extends along an axis. The limb portion has an end wall. The archery draw stop system also has a draw stopper portion configured to contact a member that is coupled to a rotary of the archery bow wherein the rotary is coupled to the limb. Also, the archery draw stop system has a stabilizer configured to engage the end wall of the limb portion to inhibit movement of the limb engager relative to the axis. The archery draw stop system includes a limb coupler configured to be inserted through the opening to couple the limb engager to the limb.

In another embodiment, the archery draw stop system includes: (a) a limb engager configured to be mounted to a limb portion of a limb of an archery bow, wherein the limb portion defines an opening; (b) a draw stopper portion configured to engage a member that is coupled to a rotary of the archery bow, wherein the rotary is coupled to the limb and configured to support a draw cord; and (c) a limb coupler configured to be inserted through the opening to couple the limb engager to the limb portion.

In yet another embodiment, a method for manufacturing an archery draw stop system includes: (a) structuring a limb engager so that the limb engager is configured to be mounted to a limb portion of a limb of an archery bow; and (b) structuring a draw stopper portion so that the draw stopper portion is configured to engage a member that is coupled to a rotary of the archery bow, wherein the rotary is coupled to the limb and configured to support a draw cord.

Additional features and advantages of the present disclosure are described in, and will be apparent from, the following Brief Description of the Drawings and Detailed Description.

DETAILED DESCRIPTION

Figure 1A:
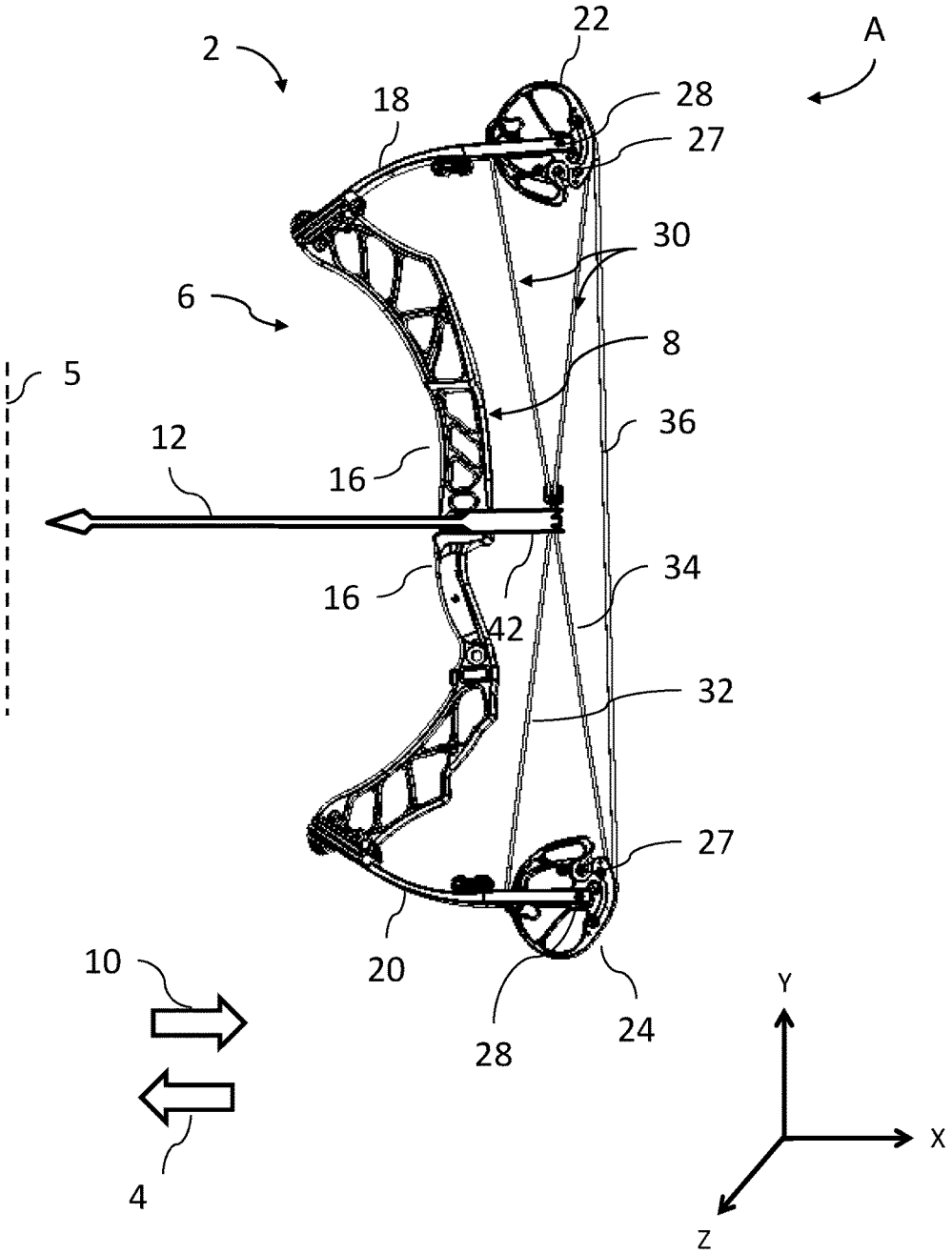
FIG. 1A is side elevation view of an embodiment of an archery bow having limbs with mounting surfaces to support a set of archery draw stop systems.
Figure 1B:
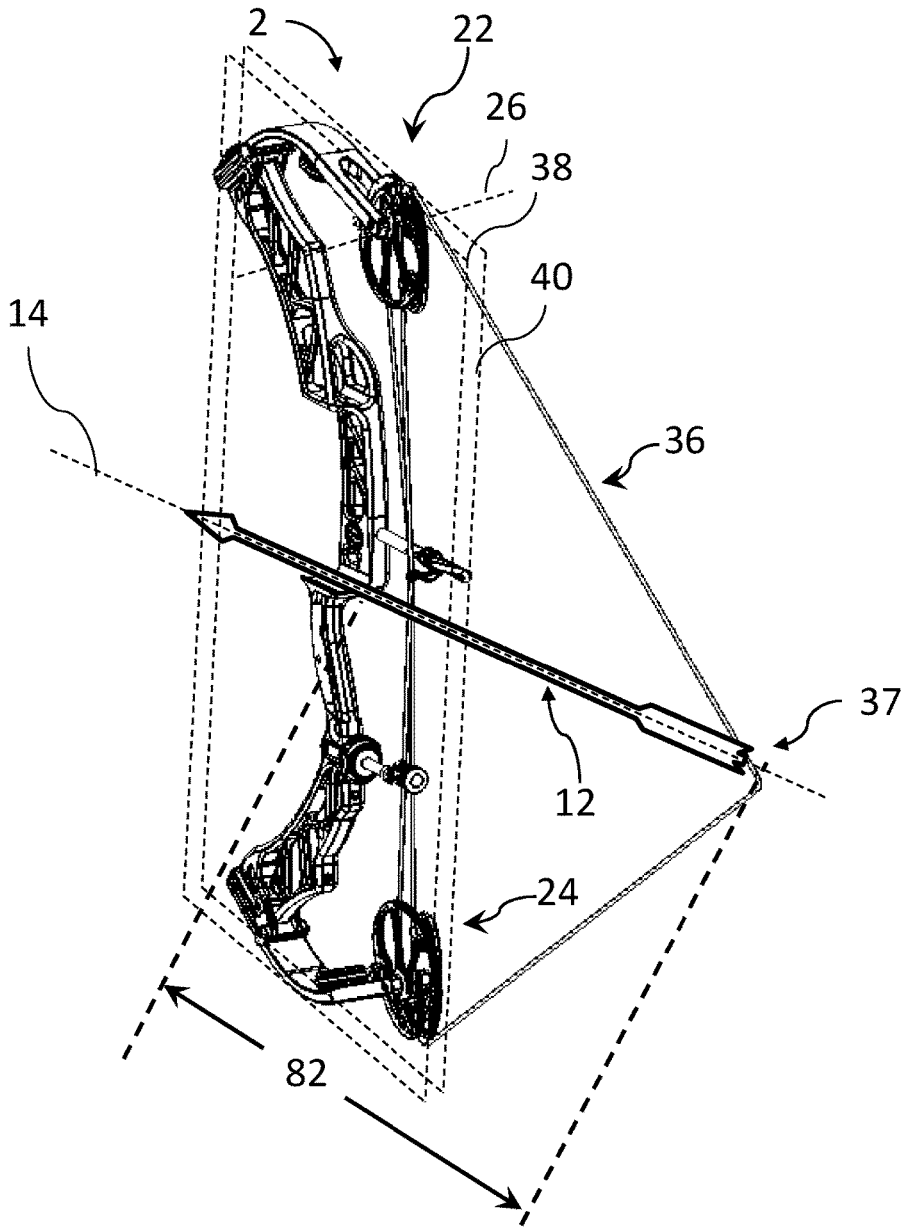
FIG. 1B is a rear isometric view of the archery bow of FIG. 1A.

FIGS. 1A-1B illustrate an embodiment of an archery bow 2. The archery bow 2 has a front 6 facing in a forward direction 4 toward a shooting target 5 and a back 8 facing in a rearward direction 10 opposite the shooting target 5. The back 8 is positioned closer to an archer or user who readies the archery bow 2 in position to fire a projectile or arrow 12 along the shooting axis 14.

The archery bow 2 also includes a riser 16. A limb 18, 20 is coupled to each end of the riser 16. Referring to FIG. 1A, a rotational wheel, pulley, cam or rotary 22, 24 is rotatably coupled to each limb 18, 20. In an embodiment, each of the rotaries 22, 24 rotates about an axis 26. At least one of the rotaries 22, 24 is an eccentric member, having one or more elliptical, asymmetric or non-circular lever portions configured to: (a) engage the drawstring, bowstring or draw cord 36; (b) engage the power line, power cord set, power cable set or supplemental cord set 30; or (c) engage both the draw cord 36 and supplemental cord set 30. The draw cord 36 and supplemental cord set 30 are spooled on the rotaries 22, 24.

In an embodiment, the supplemental cord set 30 has a plurality of supplemental cord segments 32, 34 arranged to cross each other in an X-fashion, as shown in FIG. 1A. The draw cord 36 is coupled to at least one rotary 22, 24 at an anchor point 27 and the supplemental cord set 30 is coupled to at least one rotary 22, 24 at an anchor point 28. When the draw cord 36 is drawn rearward 10, the movement of the draw cord 36 causes the rotaries 22, 24 to rotate and move toward each other. Because the supplemental cord set 30 is coupled to the anchor point 28 of at least one of the rotaries 22, 24, the rotation of the rotaries 22, 24 causes the supplemental cord set 30 to be taken-up during drawing of the draw cord 36, effectively shortening the length of the supplemental cord set 30 and drawing the limbs 18, 20 of the bow 2 closer together. In an embodiment, during the drawback process, the user experiences a decrease or let-off in the force necessary to pull and hold the draw cord 36. This force let-off is the result of the elliptical, asymmetric or non-circular lever portions of the rotaries 22, 24 and the power-assisting action of the supplemental cord set 30. Drawing the limbs 18, 20 together places them in more tension and generates potential energy that will be used to launch the arrow 12 upon release.

As illustrated in FIG. 1B, the draw cord 36 is movable within a bowstring plane 38 determined by the separated arrangement of the rotaries 22, 24. In an embodiment, a central point 37 of the draw cord 36 travels within the bowstring plane 38 to launch the arrow 12 along the shooting axis 14. In an embodiment, the arrow 12 has a protrusion, tail or fletching 42 (FIG. 1A) to aid in the aerodynamic flight performance of the arrow 12. In an embodiment, the supplemental cord set 30 travels within the power cable plane 40.

The bow 2 is operable in a full draw cycle or full cycle. The full cycle of bow 2 starts with a brace, release or undrawn condition A (FIG. 1A). Then, the bow 2 proceeds to a drawn condition B (FIG. 1B). After the user releases the draw cord 36, the bow 2 returns to the brace, release or undrawn condition A.

In the undrawn condition A (FIG. 1A), the user is not pulling rearward 10 on the draw cord 36. The undrawn condition A can occur during a brace event or a release event. During a brace event, for example, the user has not yet pulled rearward 10 on the draw cord 36, so the draw cord 36 is positioned between the rotaries 22, 24 in the undrawn condition A. During a release event, the user has already pulled rearward on the draw cord 36, the user has released the draw cord 36, and the draw cord 36 has returned to a location between the rotaries 22, 24 in the undrawn condition A.

In the drawn condition B (FIG. 1B), the user has pulled or drawn the draw cord 36 rearward 10, and the user is holding the drawstring 36 in a tight, retracted state. After the user releases the retracted draw cord 36, the bow 2 returns to the undrawn condition A, the generated potential energy is expended, and the draw cord 36 travels in the forward direction 4 toward the target 5.

Figure 2A:
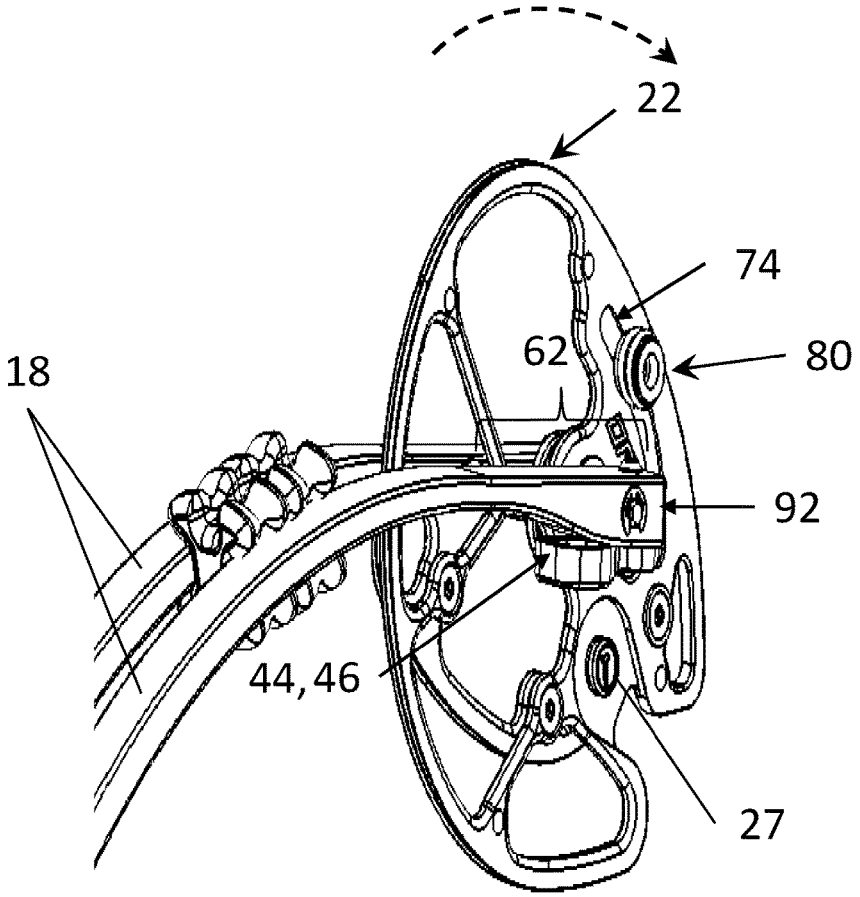
FIG. 2A is a top isometric view of an embodiment of an archery draw stop system mounted to the upper limb of the archery bow of FIG. 1A, illustrating an example of the archery draw stop system spaced apart from a rotary-mounted draw stop.

Referring to FIG. 2A, in an embodiment, the first or upper rotary 22 includes a rotary-mounted draw stop 80 functioning as a rotary-based draw length adjuster for a primary draw stop setting. The rotary-mounted draw stop 80 cooperates with the rotary-based stop track 74. The rotary-based stop track 74 penetrates laterally through the rotary 22 and extends along a portion of the circumference of the rotary 22. The rotary-based stop track 74 is arc-shaped and is defined to receive the rotary-mounted draw stop 80. The rotary-based stop track 74 is configured to be adjustably locked or secured to the rotary 22 within the rotary-based stop track 74. In an embodiment, the rotary-mounted draw stop 80 includes a fastener (e.g., a threaded screw or bolt) insertable through the rotary-based stop track 74, and the rotary-based stop track 74 includes a nut or threaded portion configured to mate with such fastener. The user can untighten the rotary-mounted draw stop 80, slide it within the rotary-based stop track 74 to a desired position, and then tighten the rotary-mounted draw stop 80 onto the rotary 22. In this way, rotary-mounted draw stop 80 enables the user to set one of a plurality of draw stop positions or draw lengths (e.g., draw length 82 shown in FIG. 1B) for the primary draw stop setting for the bow 2.

In an embodiment, each user of bow 2 can have a different, predetermined draw length 82 associated with the user's unique arm span and body size. The rotary-mounted draw stop 80 enables the user to make a primary adjustment in an effort to set the maximum draw length 82 to coincide with the point at which the rotaries 22, 24 provide the greatest reduction in force (i.e., "let off") necessary to pull back the draw cord 36.

Figure 5:
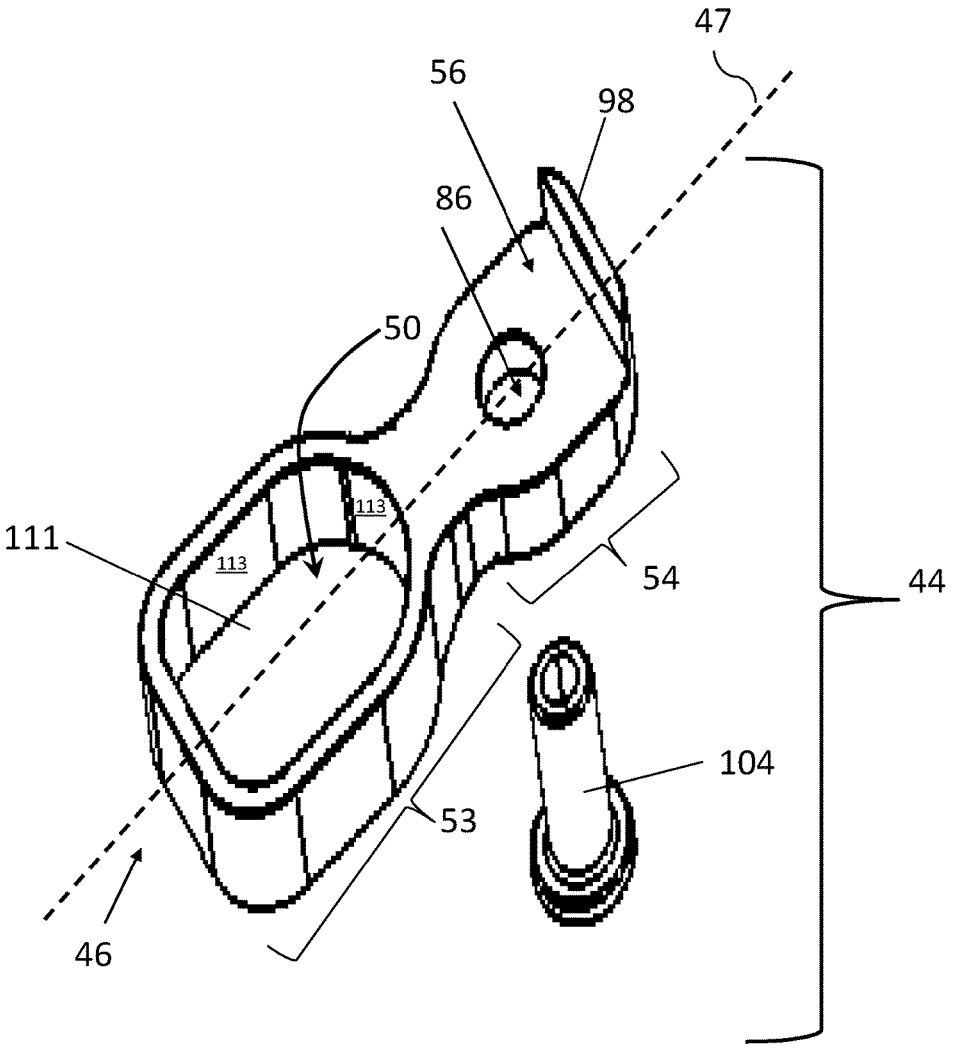
FIG. 5 is another exploded, isometric view of the archery draw stop system of FIG. 2A.
Figure 6:
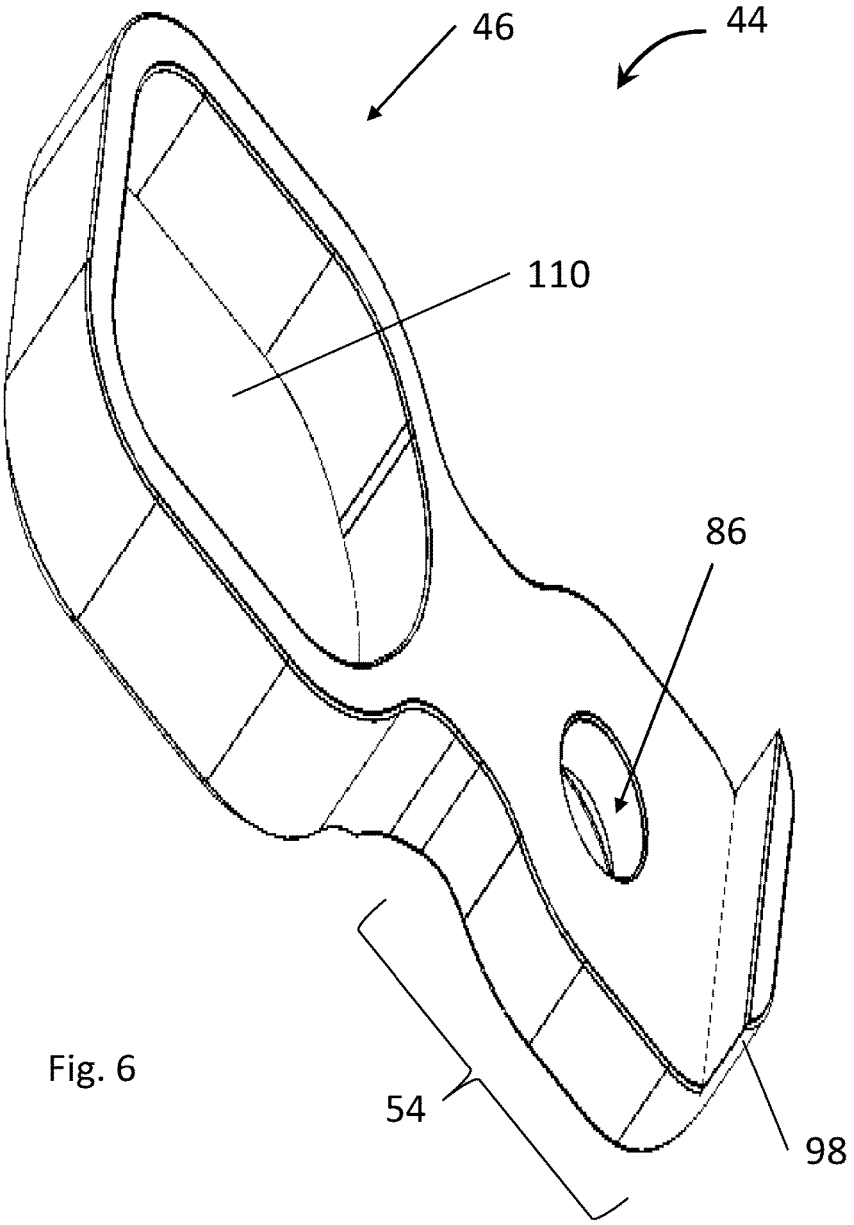
FIG. 6 is an enlarged isometric view of the archery draw stop system of FIG. 2A without the limb coupler.
Figure 7:
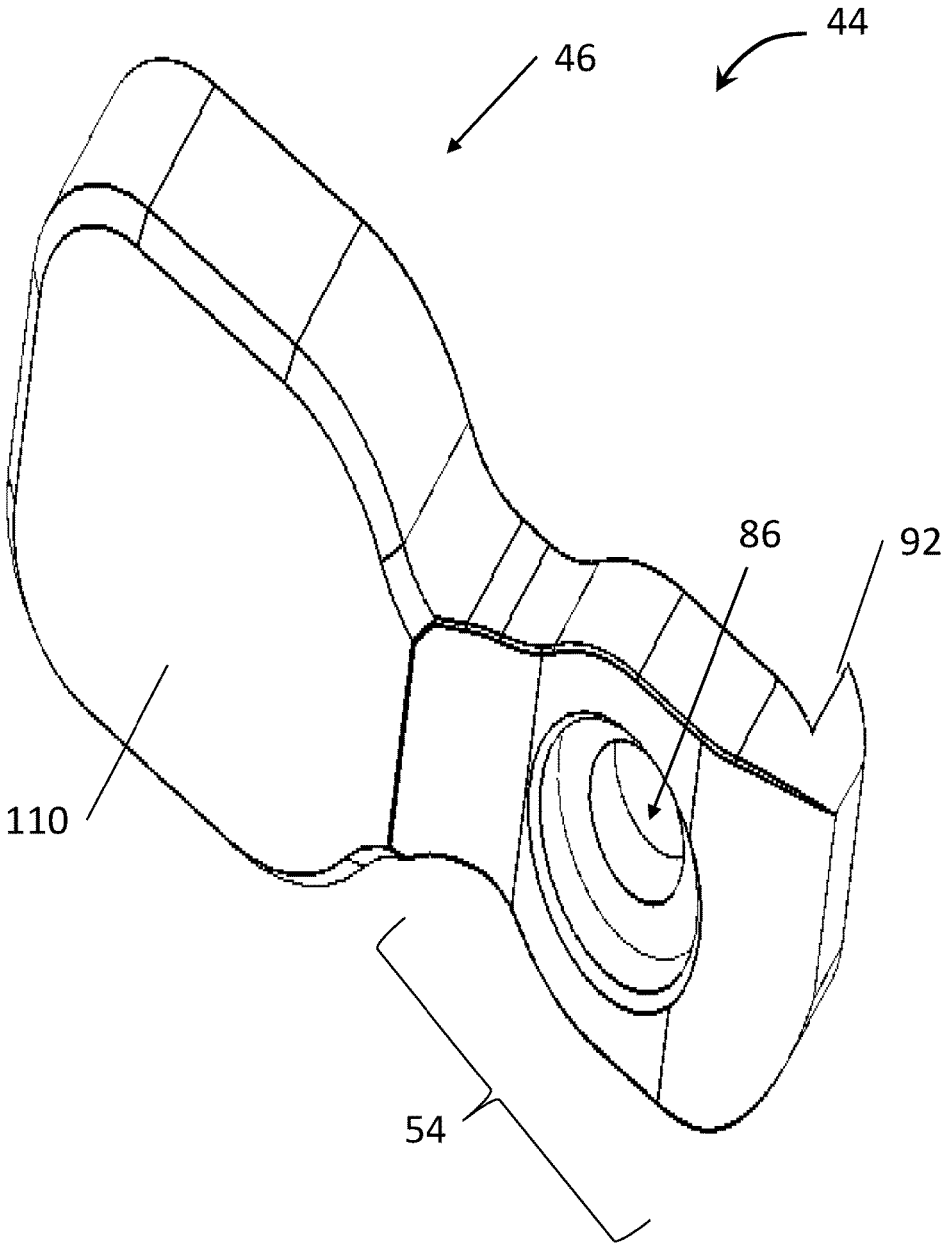
FIG. 7 is another enlarged isometric view of the archery draw stop system of FIG. 2A without the limb coupler.

Referring to FIGS. 2A-8, an embodiment of the archery draw stop system 44 is illustrated. In this embodiment, the archery draw stop system 44 provides a static, stable platform for making impact with the rotary-mounted draw stop 80. Taking into account the height 48 (FIG. 4), the user can adjust the rotary-mounted draw stop 80 to maintain the desired draw length 82 for such user. In this embodiment, further illustrated by FIGS. 4-8, the draw stop system 44 includes a body 46 having the height 48. The body 46, extending along body axis 47, includes: (a) a stopper portion 53 configured to engage the rotary 22 or the rotary-mounted draw stop 80; and (b) a limb engager 54 configured to be mounted to a distal limb portion 62 (FIG. 2A) of the first or upper limb 18. The limb portion 62 extends along a limb axis 68 (FIG. 2B) and has an end wall 92. The archery draw stop system 44 also includes a stabilizer 98 that extends upright from the limb engagement surface 56 (FIG. 5). The stabilizer 98 engages or contacts the end wall 92 of the limb portion 62 to inhibit or prevent twisting or other movement of the limb engager 54 relative to the limb axis 68. For example, in an embodiment, the stabilizer 98 hooks and holds the limb engager 54 onto the end wall 92 so that the body axis 47 does not rotate, change or move relative to the limb axis 68.

Figure 8:
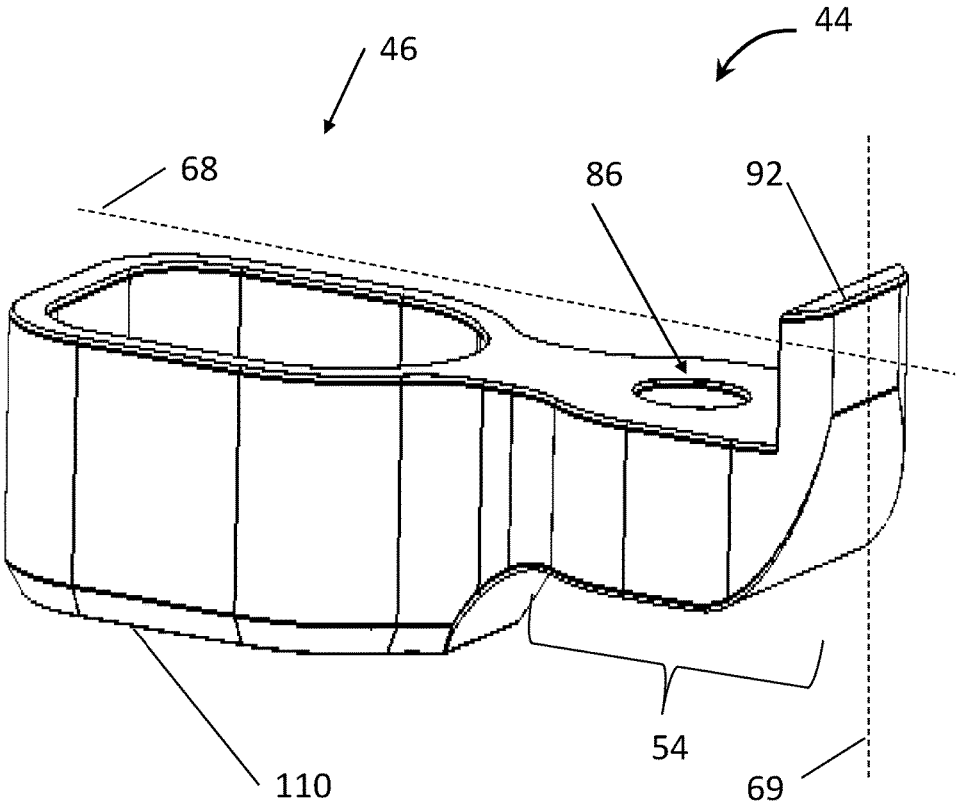
FIG. 8 is an enlarged, side isometric view of the archery draw stop system of FIG. 2A without the limb coupler.

In the embodiment illustrated in FIG. 8, the body 46 extends along the limb axis 68 when the archery draw stop system 44 is mounted to the limb 18, 20. Also, the stabilizer 98 extends from the body 46 along a stabilizer axis 69. The limb axis 68 extends in a first plane, and the stabilizer axis 69 extends in a second plane. The first plane intersects with the second plane. This configuration aids in stabilizing, seating and securing the archery draw stop system 44 on the limb 18, 20.

The limb engager 54 also defines an opening or through hole 86 extending through the limb engager 54. Also, the archery draw stop system 44, in an embodiment, includes a limb coupler 104, such as a threaded screw, bolt or pin. The limb coupler 104 is configured to be inserted through the opening 86 to fasten, mount or otherwise couple the limb engager 54 to the limb portion 62. In the embodiment shown in FIG. 3, the limb portion 62 defines an internally-threaded limb hole 64. The user or an installer can rotate the threaded limb coupler 104 within the threaded limb hole 64 to secure the limb engager 54 to the limb portion 62. In another embodiment not shown, the limb coupler 104 is connected to, integral with or incorporated into the body 46. For example, the limb coupler 104 can include an adhesive or a magnetic characteristic operable to magnetically couple the archery draw stop system 44 to the limb portion 62.

Figure 9:
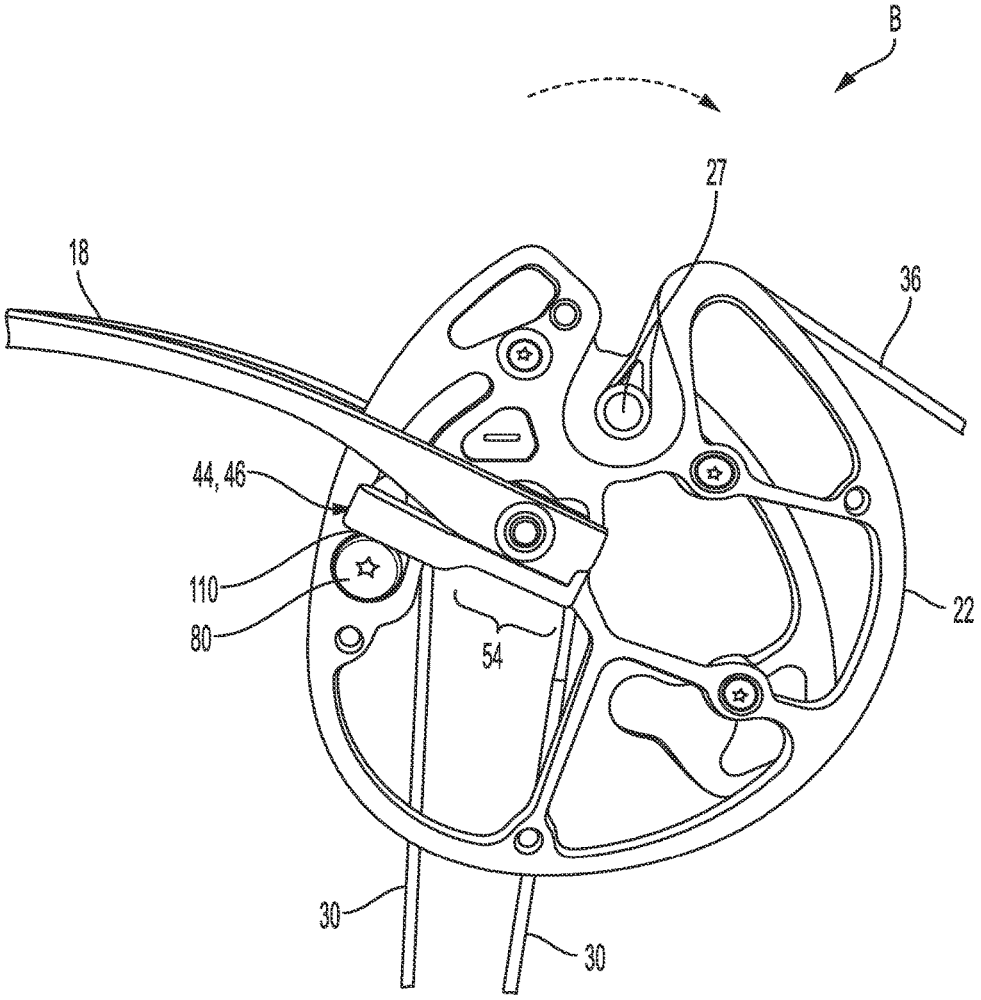
FIG. 9 is an isometric view of an embodiment of the archery draw stop system of FIG. 2A, illustrating an example of the archery draw stop system in contact with a rotary-mounted draw stop.
Figure 10:
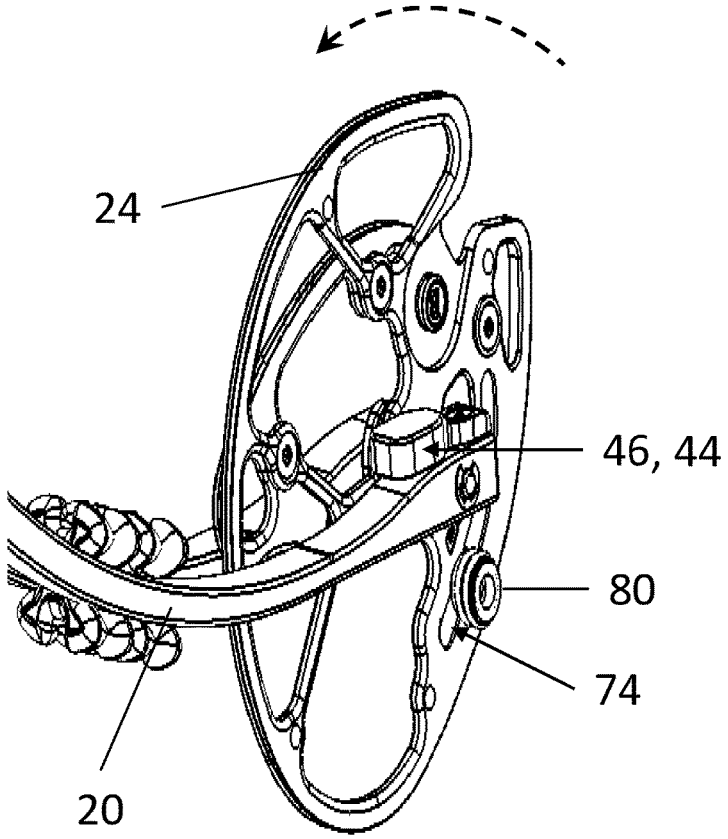
FIG. 10 is an isometric view of an embodiment of the archery draw stop system of FIG. 2A, illustrating the archery draw stop system mounted to a lower limb.

The body 46 additionally has a draw stopper pad or draw stop surface 110 (FIG. 4) coupled to the stopper portion 53. When the rotary 22 rotates during a transition of the bow 2 from the undrawn position A to the drawn position B (FIG. 9), the draw stopper surface 110 is configured to physically contact the rotary-mounted draw stop 80 (coupled to the rotary 22) to stop the rotation of the rotary 22 beyond a desired draw stop position. It should be understood that the archery draw stop system 44 can also be mounted to the second or lower limb 20 as illustrated in FIG. 10.

In the embodiment illustrated in FIG. 5, the stopper portion 53 of the body 46 defines a body cavity 50. The body cavity 50 is bound by the floor 111 and the side walls 113. The body cavity 50 decreases the amount of material and weight required for the archery draw stop system 44. Alternatively, the body cavity 50 is configured to hold components or elements related to the stopping or coupling functions described above.

Figure 2B:
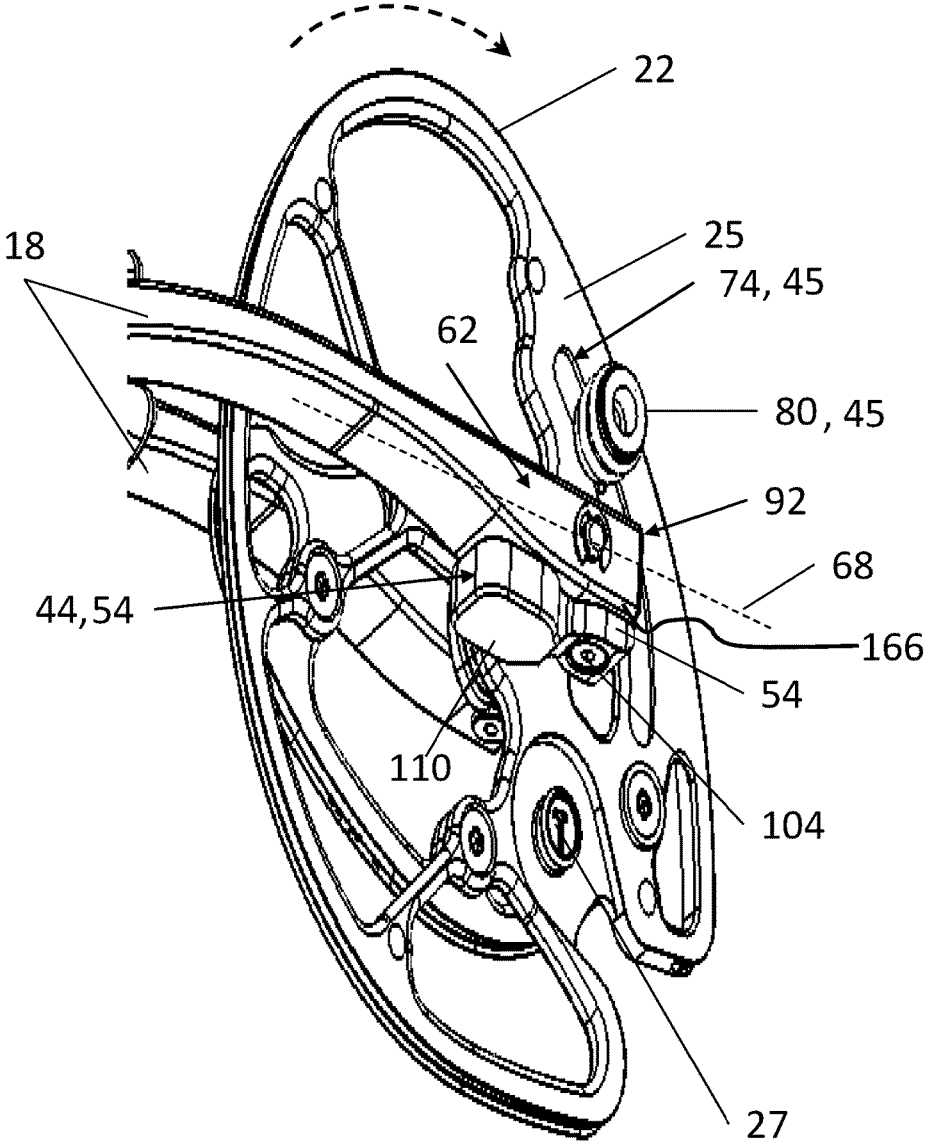
FIG. 2B is a bottom isometric view of an embodiment of the archery draw stop system of FIG. 2A, illustrating an example of the archery draw stop system spaced apart from a rotary-mounted draw stop.
Figure 3:
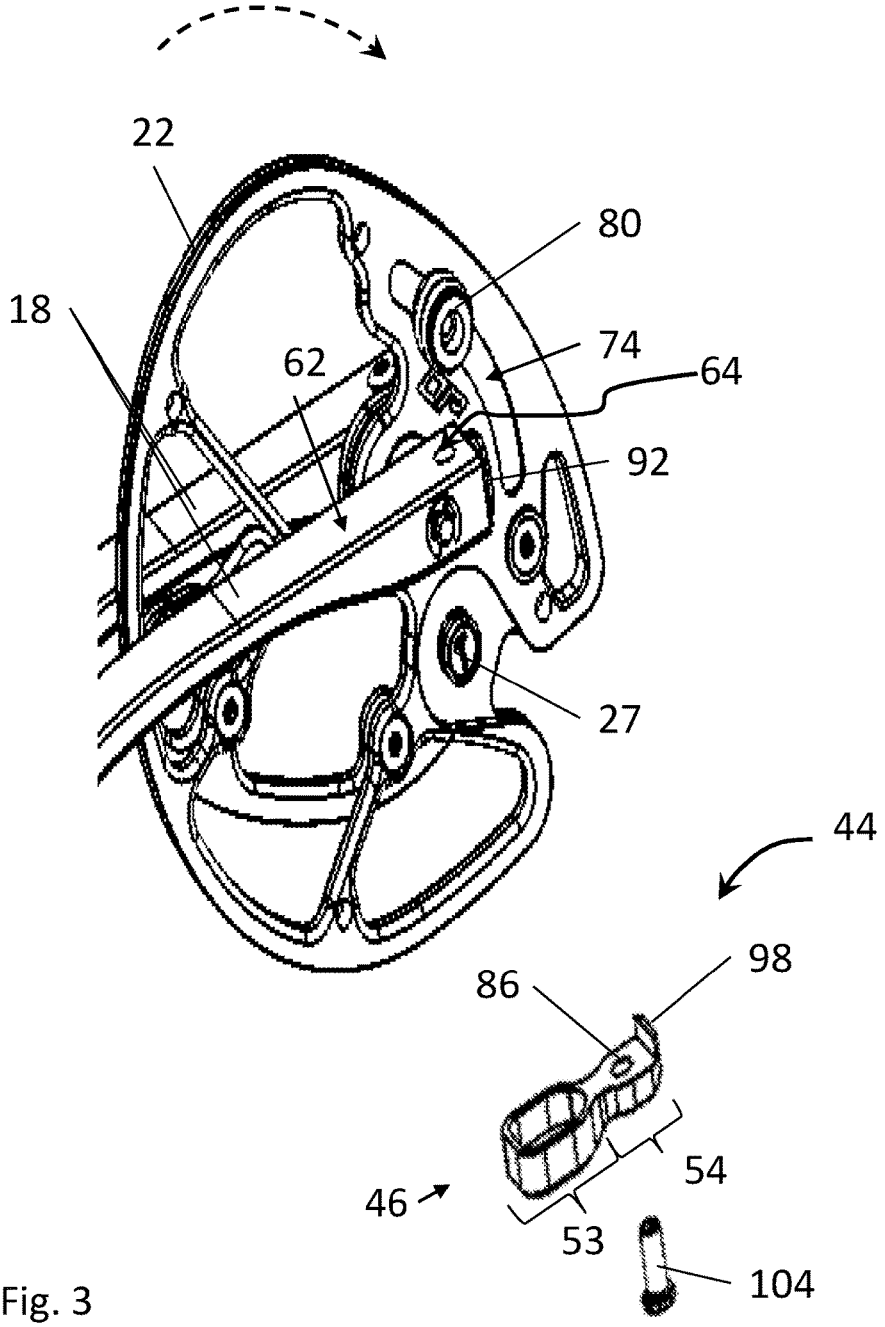
FIG. 3 is a bottom isometric view of an embodiment of the archery draw stop system of FIG. 2A, illustrating the archery draw stop system removed from the limb.
Figure 4:
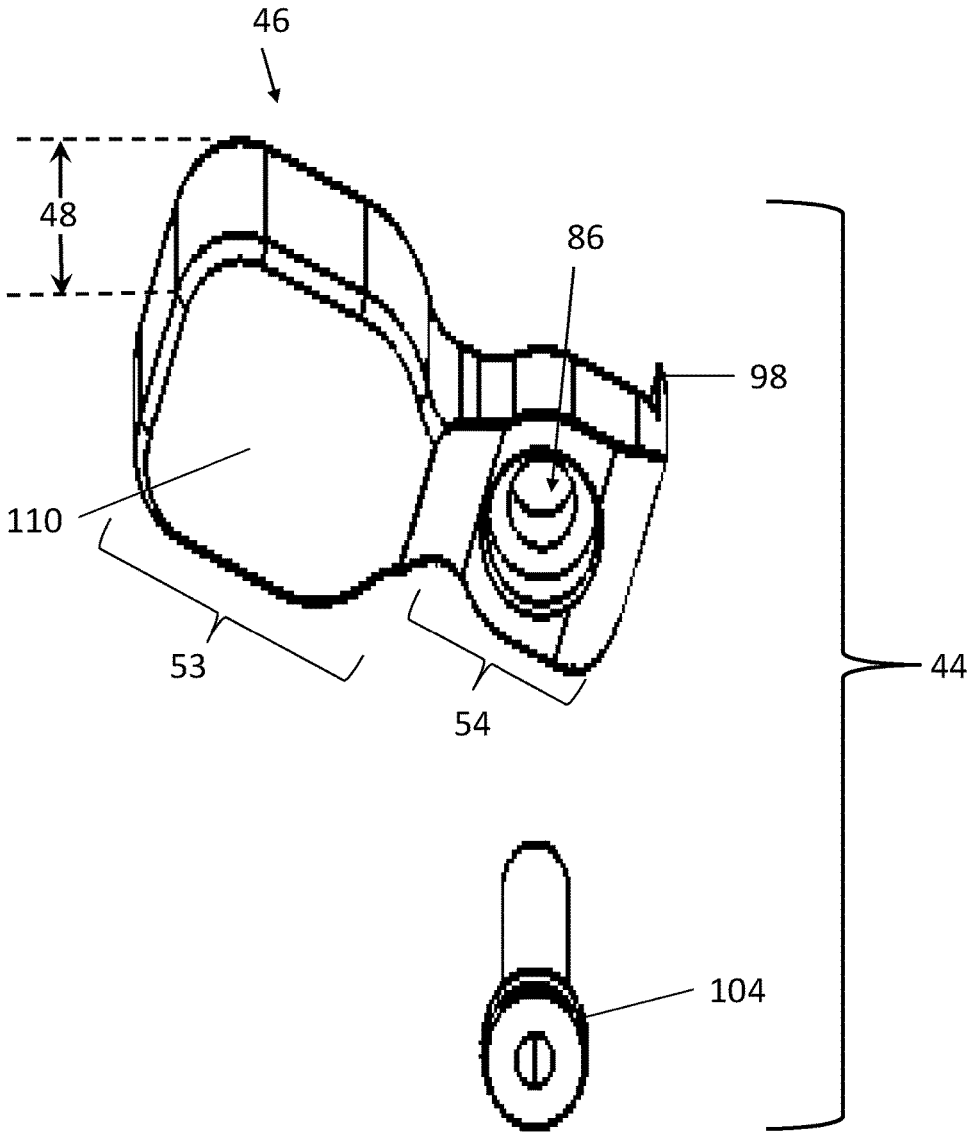
FIG. 4 is an exploded, isometric view of the archery draw stop system of FIG. 2A.

In another embodiment, neither of the rotaries 22, 24 include any rotary-mounted draw stops 80. Instead, rotary 22, for example, includes a portion or member (not shown) that projects from the rotary face 25 (FIG. 2B). Such rotary member can be statically fixed to the rotary face 25, or it can be moveable between a down position in which it lies substantially flat on the face and an up position in which it stands upright on the rotary face 25. In either case, such rotary member can be configured so that, as the rotary 22 rotates, such rotary member interferes with, and makes physical contact with, the stopper surface 110. Depending upon the embodiment, such rotary member can be integral with the rotary 22 as a unitary structure, or such rotary member can be a separate component attached to the rotary 22.

In another embodiment, the archery draw stop system 44 includes a kit of differently sized bodies. Such body kit enables the user to establish a supplemental or secondary draw stop setting for the bow 2 after the primary adjustment of the rotary-mounted draw stop 80. For example, such kit can include: (a) body 46 having height 48 (FIG. 4) corresponding to a draw length 82 (FIG. 1B); (b) a second body of the same shape as body 46 but having a height two-thirds of height 48 corresponding to a draw length X greater than draw length 82; and (c) a third body of the same shape as body 46 but having a height one-half of height 48 corresponding to a draw length Y greater than draw length X. In an embodiment, the body 46, second body and third body are differently colored or marked to visually indicate the different draw lengths.

In an embodiment, a duel draw stop system (not shown) includes the body kit described above, the rotary-mounted draw stop 80, and the rotary-based stop track 74. In this embodiment, the user can primarily adjust the draw length by repositioning the rotary-mounted draw stop 80 within the rotary-based stop track 74. Then, the user can secondarily adjust such draw length, for fine-tuning or micro-tuning purposes, by selecting one of a set of differently-sized bodies (such as body 46) and attaching the selected body to the bow 2. In doing so, the body height 48 (FIG. 4) of the selected body effectively decreases the draw length by the magnitude of the body height 48.

Another embodiment includes a limb-mountable, adjustable archery draw stop system 112, as illustrated in FIGS.

Figure 11:
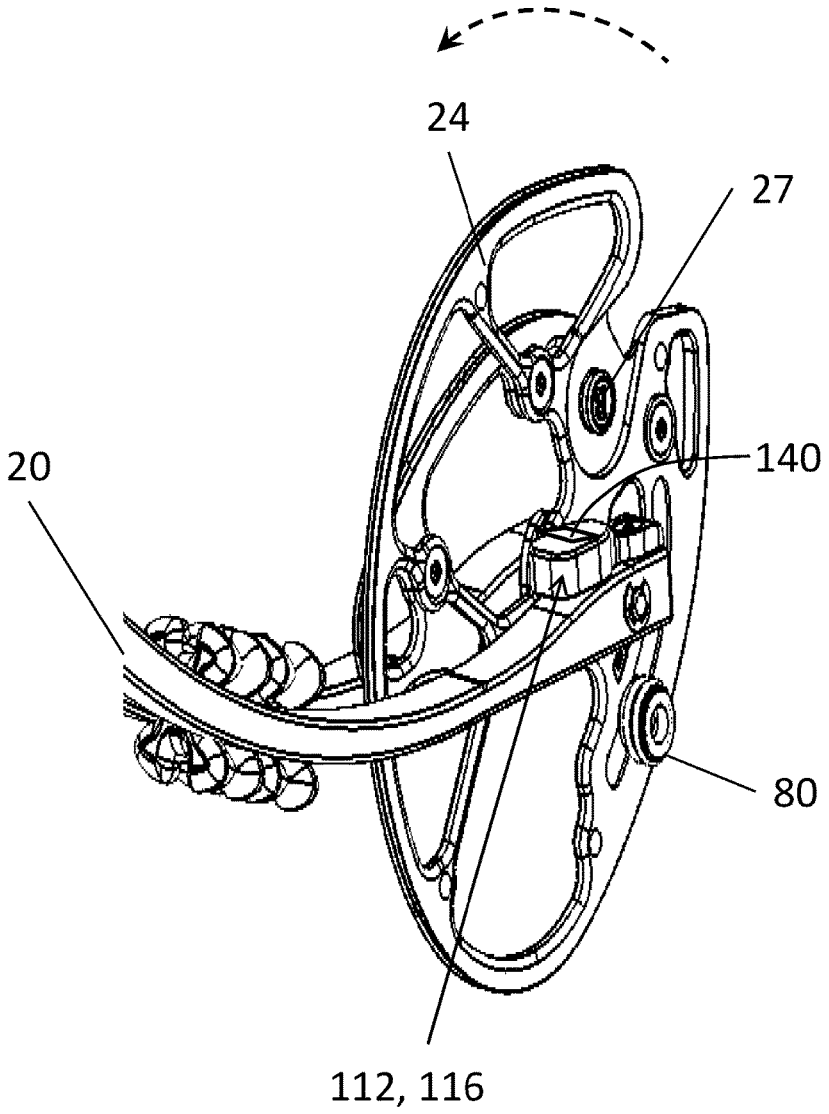
FIG. 11 is an isometric view of an embodiment of an adjustable archery draw stop system mounted to the lower limb of the archery bow of FIG. 1A.

11-13. The adjustable archery draw stop system 112 includes a body 116. Body 116 includes: (a) a limb engager 122 configured to be mounted to a limb 20; and (b) a stopper portion 123 configured to engage the rotary 24 (FIG. 11) or the rotary-mounted draw stop 80 (FIG. 11). The limb engager 122 defines an opening 128 through which a limb coupler 134 (e.g., a screw, bolt or pin) extends or is inserted to couple the limb engager 122 to the limb 20. The body 116 also has a stabilizer 158 extending from the limb engager 122 and interfacing with the end wall 92 of the limb 20 to prevent or inhibit movement of the body 116, performing the same function as the stabilizer 98.

Figure 12:
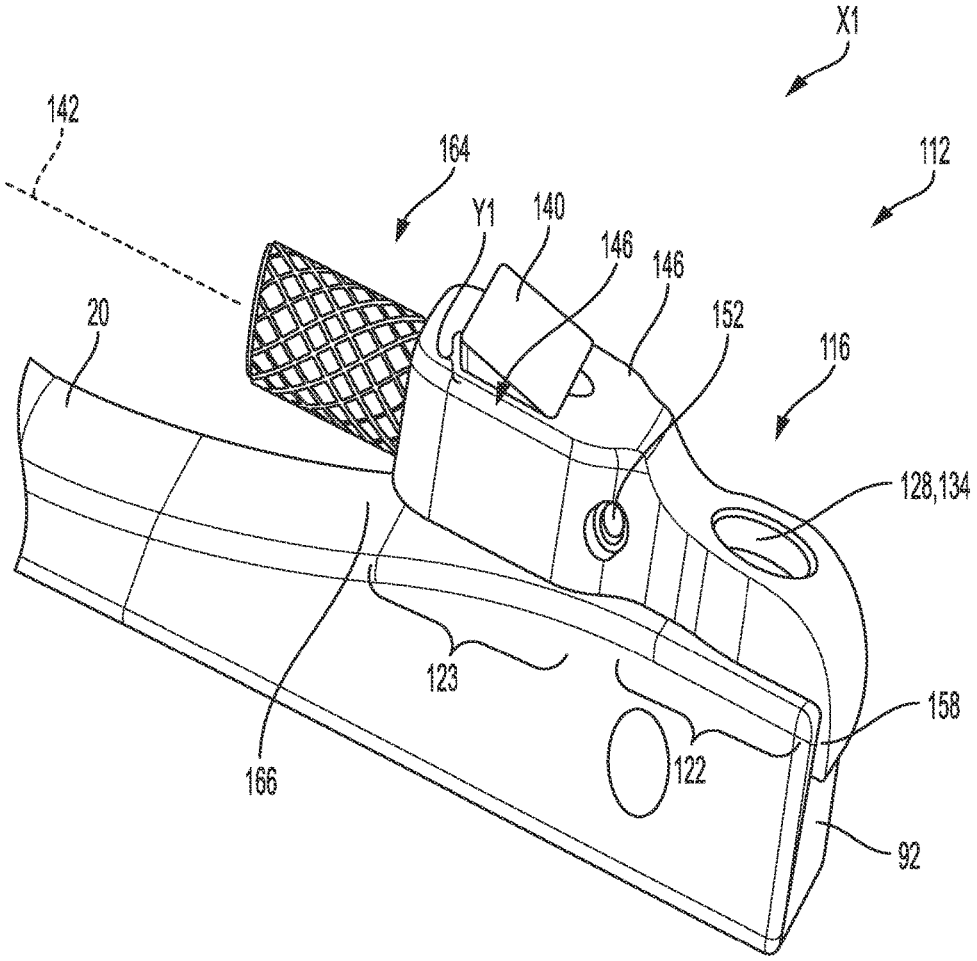
FIG. 12 is an enlarged isometric view of the adjustable archery draw stop system of FIG. 11, illustrating the contact member having a first position relative to the body of the adjustable archery draw stop system.
Figure 13:
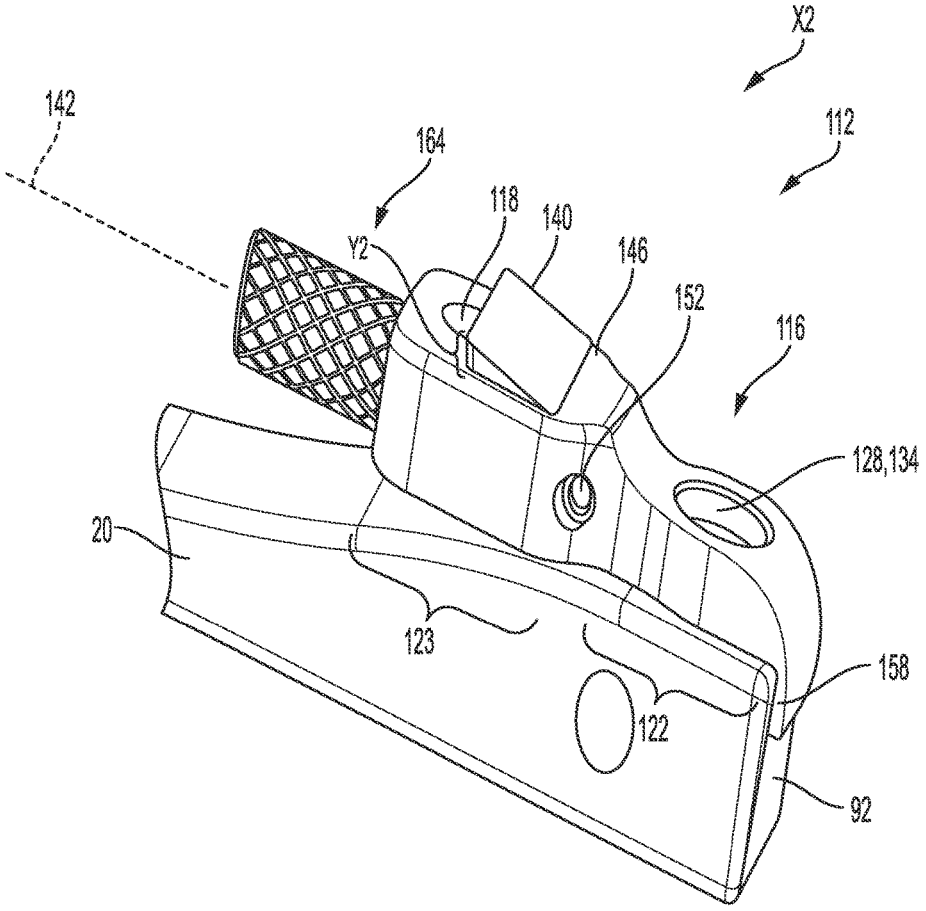
FIG. 13 is an enlarged isometric view of the adjustable archery draw stop system of FIG. 11, illustrating the contact member having a second position relative to the body of the adjustable archery draw stop system.
Figure 14:
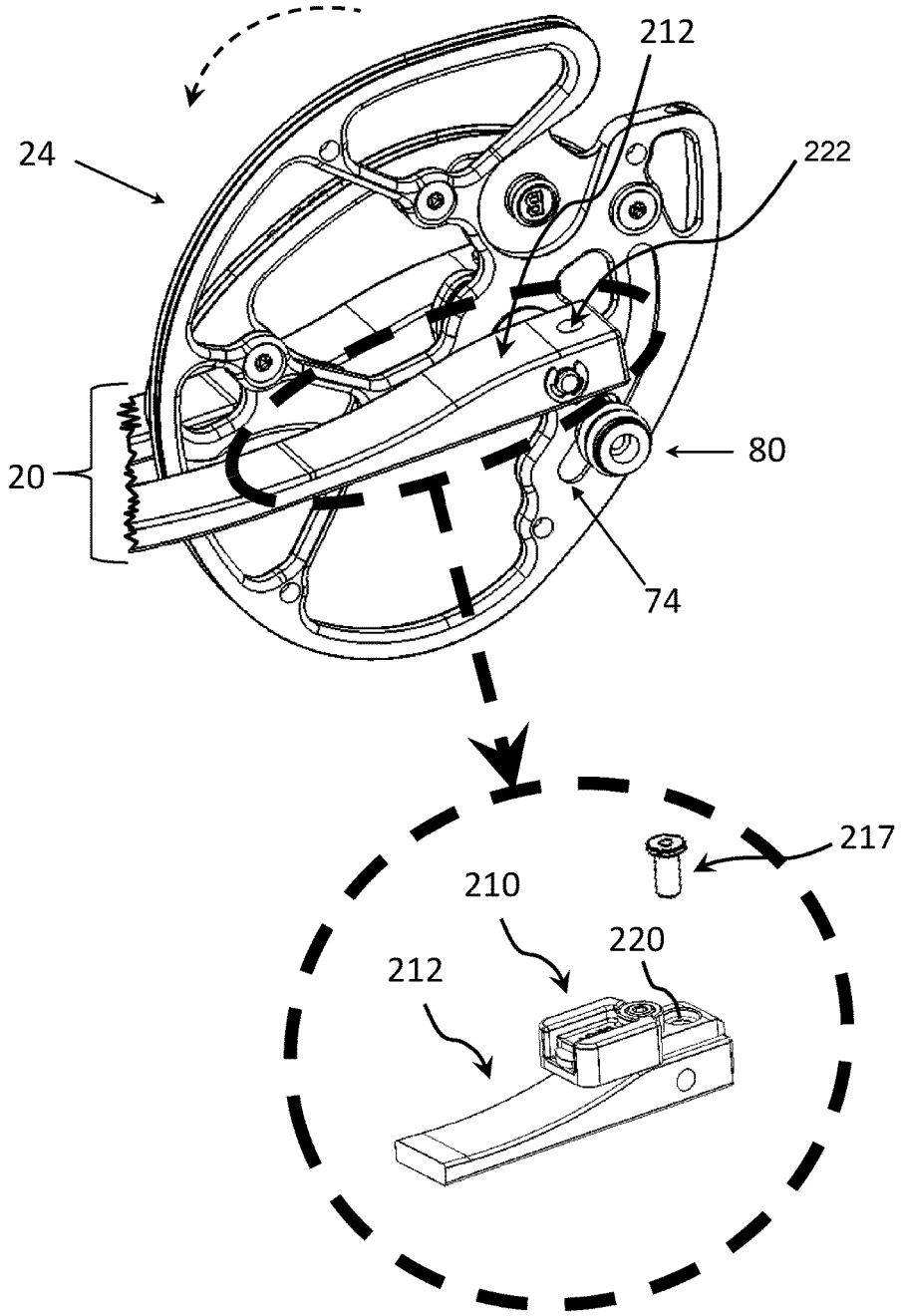
FIG. 14 is an isometric view of another embodiment of an archery draw stop system.
Figure 15:
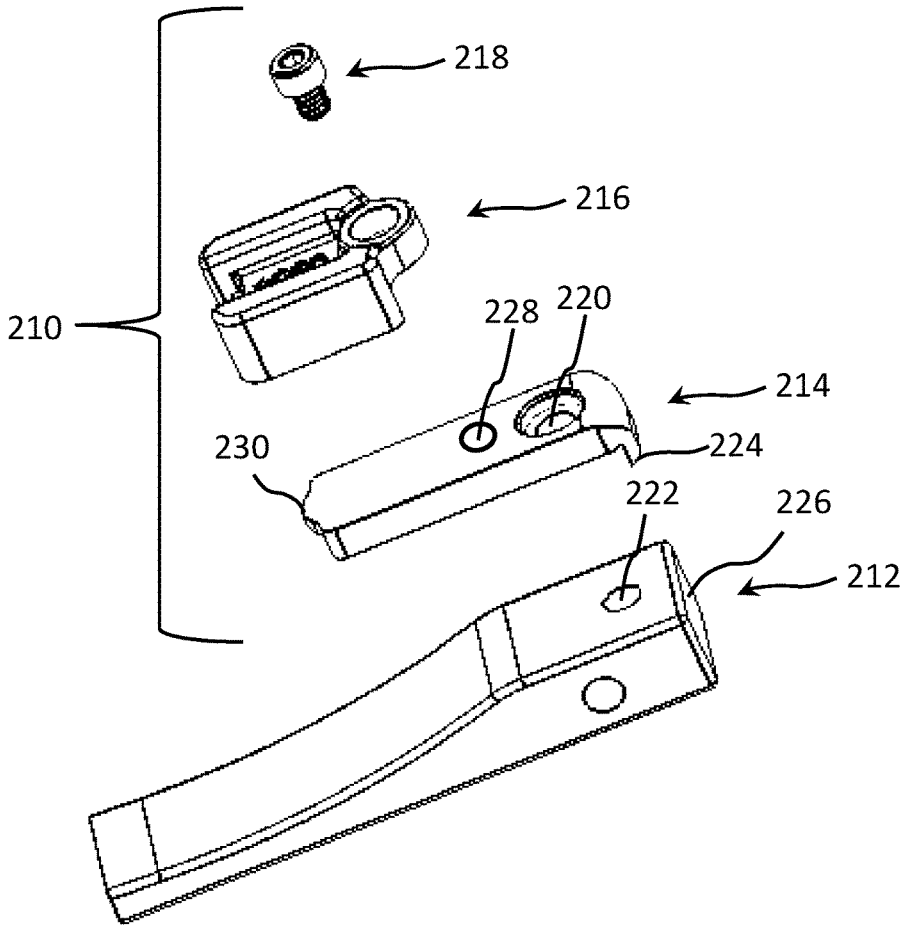
FIG. 15 is an exploded, isometric view of the archery draw stop system of FIG. 14, illustrating the archery draw stop system detached from the limb portion.

The body 116 also defines a body cavity 118 (FIG. 13) configured to at least partially receive a slidable, angled draw stopper surface, follower or contact member, such as the slidable ramp 140 shown in FIGS. 12-13. The ramp 140 is configured to slide within the body cavity 118 along an axis 142 between a variety of positions along the axis 142. For example, the ramp 140 can be adjusted from a first position X1 (FIG. 12) on axis 142 in which the ramp 140 is raised a distance Y1 from the body surface 146 to a second position X2 (FIG. 13) on axis 142 in which the ramp 140 is raised a distance Y2 from the body surface 146. In this example, the distance Y2 is greater than the distance Y1.

The adjustable archery draw stop system 112 includes a driver 164 rotatably coupled to the body 116. In this embodiment, the driver 164 extends along the axis 142 and is threadably engaged with the body 116. The distal end (not shown) of the driver 164 is located within the cavity 118 (FIG. 13) and operatively coupled to the ramp 140. By rotating the driver 164, the user can cause the distal end to move along the axis 142 which, in turn, causes the ramp 140 to move along the axis 142. A clockwise rotation of driver 164 will slide the ramp 140 in a first direction causing an increase in draw length, and a counterclockwise rotation of driver 164 will slide the ramp 140 in the opposite direction causing a decrease in draw length. In an embodiment, the driver 164 includes a grasp or fastener head configured to enable the user to finger-twist the driver 164 or to rotate the driver 164 using a tool. The adjustable archery draw stop system 112 also includes a position lock 152, such as a set screw. By tightening and untightening the position lock 152, the user can fix and free the position of the ramp 140, respectively. This twist-based adjustment method enables the user to perform fine or micro adjustments of the draw length in a controlled, repeatable fashion. Once the user arrives at the desired axial position of the ramp 140, the user can operate the position lock 152 to fix or secure the position of the ramp 140 relative to the body 116. In this way, the archery draw stop system 112 enables the user to make a secondary adjustment of the draw length for fine-tuning purposes in conjunction with the primary adjustment of the rotary-mounted draw stop 80 (FIG. 2B).

It should be appreciated that, in another embodiment, the adjustable archery draw stop system 112 is operable to adjust the draw length of a bow without including or relying upon the rotary-mounted draw stop 80 or the rotary-based stop track 74. For example, the archery draw stop system 112 can be operable to contact any suitable portion or member (not shown) that projects from the rotary face 25 (FIG. 2B). Such rotary member can, for example, be moveable between a down position in which it lies substantially flat on the face 25 and an up position in which it stands upright on the rotary face 25. In such embodiment, the user can make all adjustments of the draw length 82 (e.g., macro and micro adjustments) using the adjustable archery draw stop system 112.

In other embodiments, an adjustable archery draw stop system can include a body 46 or 116 in combination with any suitable component configured to be moveably coupled to such body 46, 116. By adjusting the position of such component relative to the body 46, 116 and/or limb 18, 20, the body 46, 116 (or a portion thereof) can undergo a change in height relative to the limb surface 166 (FIGS. 2B and 12). This change in height enables the user to adjust the draw length of the bow, as described above. Although the adjustable archery draw stop system 112 is illustrated in FIGS. 11-13 as being coupled to a lower limb 20, it should be appreciated that the adjustable archery draw stop system 112 is configured to be coupled to an upper limb 18 (FIG. 1A). In such case, the adjustable archery draw stop system 112 provides the upper rotary 22 with the same stopping function as for the lower rotary 24 except that the stopping force is exerted in the opposite direction.

In an embodiment illustrated in FIGS. 14-17, the archery draw stop system 210 is configured to be mounted to the limb portion 212 of the limb 20. In an embodiment, the archery draw stop system 210 includes: (a) a support or base 214 that is attachable to the limb portion 212; (b) a draw stopper 216 that is removably attachable to the base 214; (c) a limb coupler 217 configured to attach or couple the base 214 to the limb portion 212; and (d) a stopper coupler 218 configured to attach or couple the draw stopper 216 to the base 214.

In an embodiment, the base 214 defines a pilot hole or opening 220 configured to receive the limb coupler 217. Though the limb coupler 217 is illustrated as a threaded screw, it should be appreciated that the limb coupler 217 can include any suitable, screw, bolt, pin or other suitable fastener. A user can attach the base 214 to the limb portion 212 by placing the base 214 on the limb portion 212 and then inserting the limb coupler 217 through the opening 220 and into the threaded hole or opening 222 of the limb portion 212. After rotating the limb coupler 217, the base 214 will be mounted to the limb portion 212. In an embodiment, the base 214 has a hook portion or stabilizer 224 that extends to engage the end wall 226 of the limb portion 212. As described in other embodiments above, the stabilizer 224 enhances the securement and stationary seating of the base 214 on the limb portion 212. The base 214 also defines a threaded hole or opening 228 and an extension, tab or lip 230.

Figure 16A:
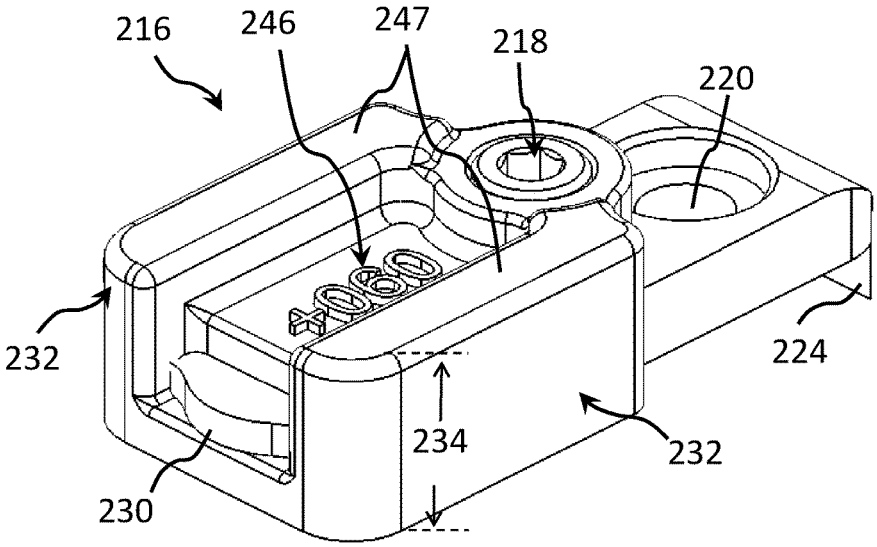
FIG. 16A is an enlarged, top isometric view of the archery draw stop system of FIG. 14.
Figure 17:
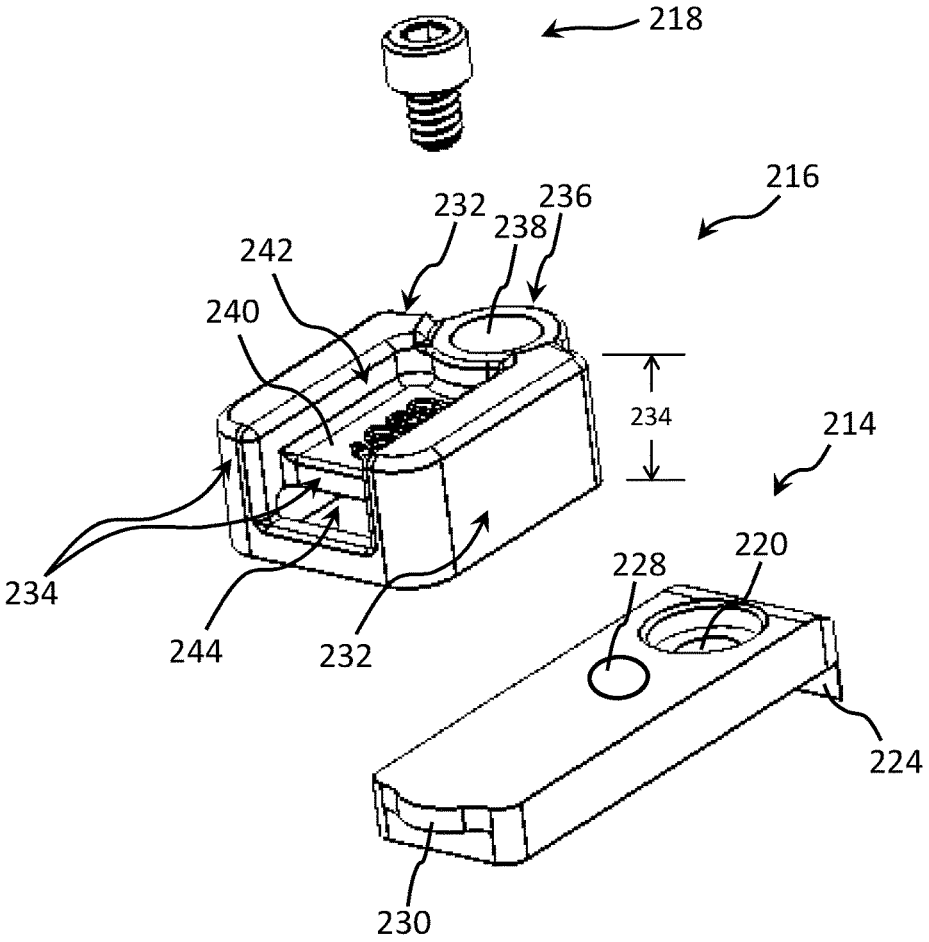
FIG. 17 is an enlarged, exploded, isometric view of the archery draw stop system of FIG. 14.
Figure 18:
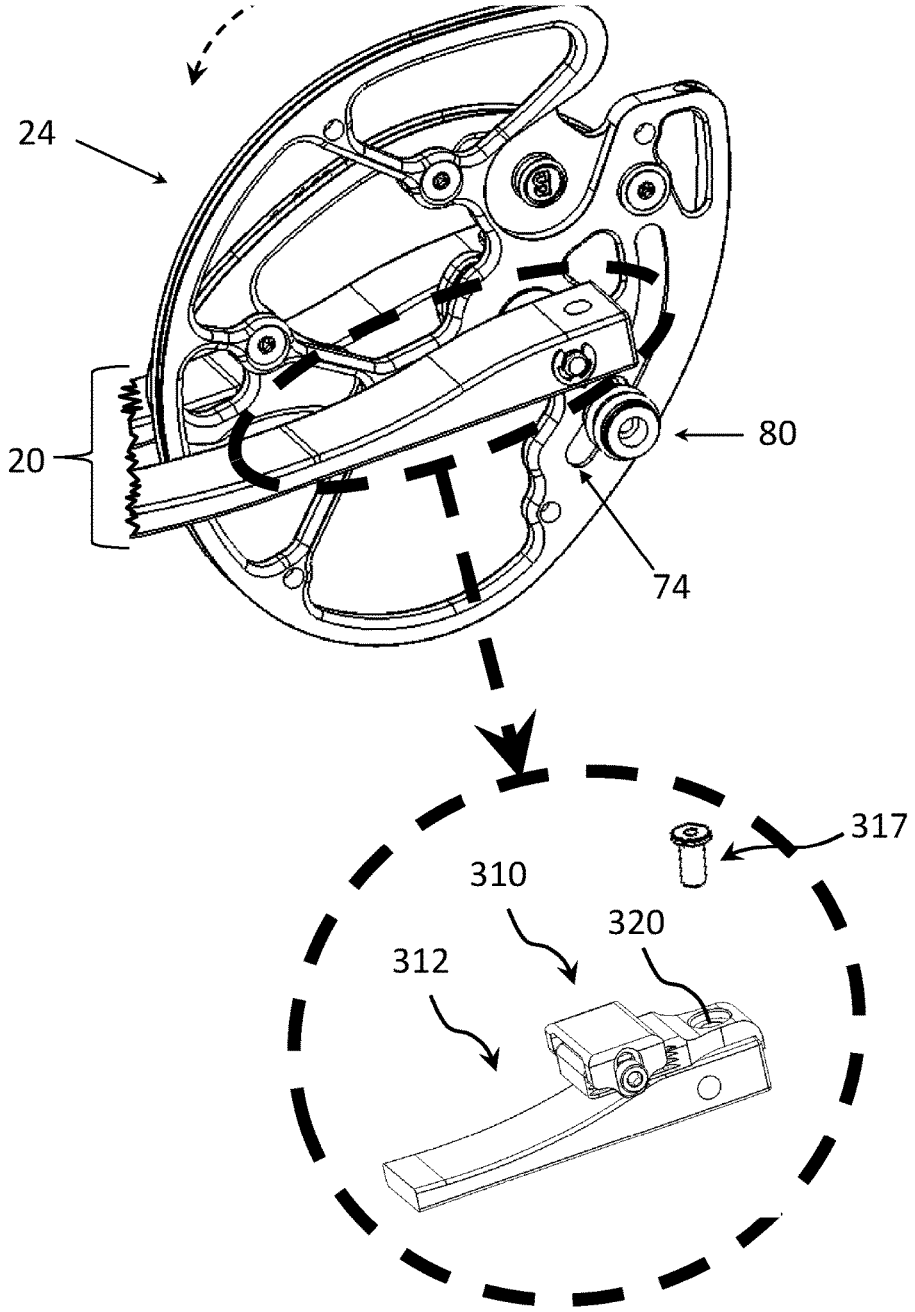
FIG. 18 is an isometric view of yet another embodiment of an archery draw stop system.
Figure 19:
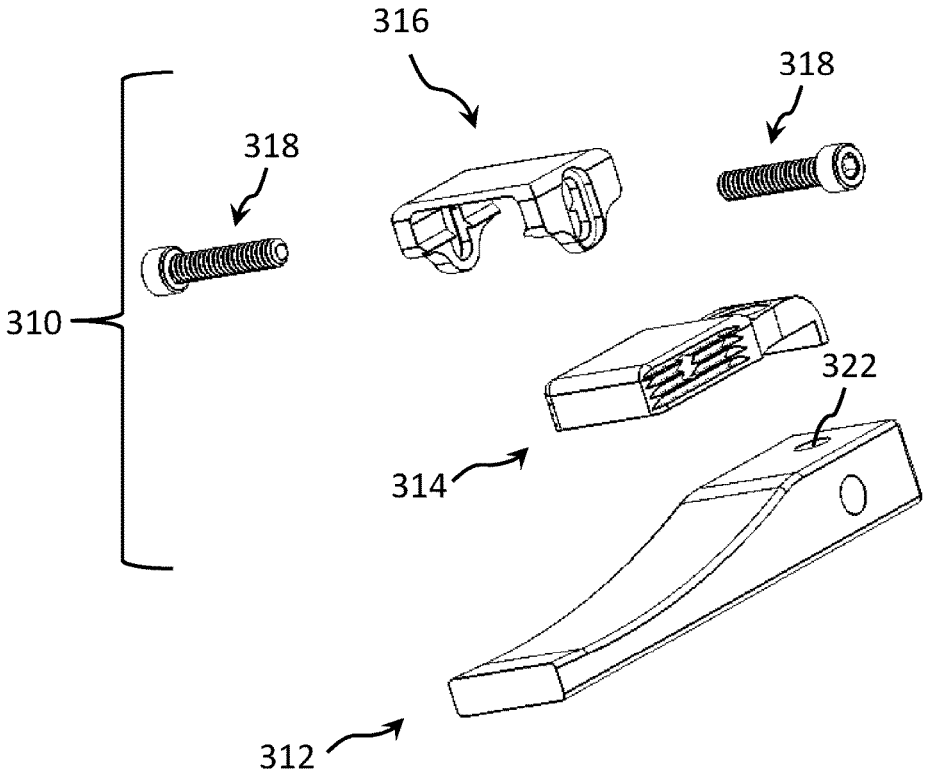
FIG. 19 is an exploded, isometric view of the archery draw stop system of FIG. 18.

Referring to FIGS. 16A and 17, in an embodiment, the draw stopper 216 includes: (a) a spacer 232 having a height 234 corresponding to a designated adjustment of the draw stop for the rotary 24 (FIG. 14), as described above; (b) a receiver 234 configured to receive and engage the base 214; and (c) a coupling portion 236 defining a hole or opening 238. The receiver 234 has an intermediate floor 240 that is positioned to define an upper cavity 242 and a lower cavity 244. The spacer 232 has a stopper surface 247 configured to physically contact rotary 24, a portion thereof or the draw stop member 80 that is coupled to the rotary 24. As described above, the interference between the stopper surface 247 and the rotary 24, a portion thereof or the draw stop member 80 causes the rotary 24 to stop from rotating relative to the bow 2. The stoppage determines the draw length of the bow 2.

Figure 16B:
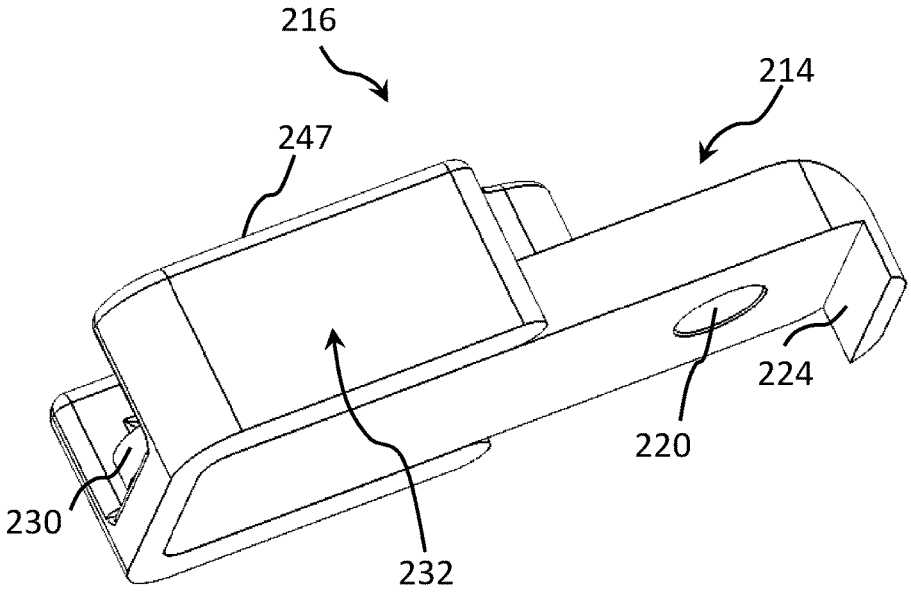
FIG. 16B is an enlarged, bottom isometric view of the archery draw stop system of FIG. 14.

A user can attach the draw stopper 216 to the base 214 by sliding the draw stopper 216 along the base 214 until the base 214 is inserted into the lower cavity 242 and the lip 230 protrudes beyond the intermediate floor 240, as illustrated in FIGS. 16A-16B. Next, the user can insert the stopper coupler 218 through the opening 238 and then screw the stopper coupler 218 into the threaded hole or threaded opening 228. After rotating the stopper coupler 218, the draw stopper 216 will be secured to the base 214. Though the stopper coupler 218 is illustrated as a threaded screw, it should be appreciated that the stopper coupler 218 can include any suitable, screw, bolt, pin or other suitable fastener.

As illustrated in FIG. 16A, the draw stopper 216 includes, bears or otherwise displays a stop adjustment indicator 246. The stop adjustment indicator 246 indicates designated data or a designated metric associated with an adjustment of the draw stop setting for the rotary 24. In the example shown, the stop adjustment indicator 246 indicates "+060," which indicates an increase in the magnitude of draw stoppage (resulting in a decrease in the draw length) by 0.060 inches or 0.60 inches. In an embodiment, the metric indicated by the stop adjustment indicator 246 is equal to or dependent upon the magnitude of the height 234.

Another embodiment includes the base 214 that is usable in conjunction with a set or a kit of a plurality of different draw stoppers, including the draw stopper 216. Each of the draw stoppers in the kit has the same structure, elements and function as the draw stopper 216 except that the heights of the draw stoppers vary. For example, height 234 of the draw stopper 216 may be 0.060 inches, height X of another draw stopper in the kit may be 0.030 inches, and height Y of yet another draw stopper in the kit may be 0.50 inches. The kit of draw stoppers enables the user to easily adjust the draw stop setting by replacing one installed draw stopper with another one. The replacement process is convenient in that it involves unscrewing of a coupler and sliding out of the draw stopper.

In another embodiment illustrated in FIGS. 18-22B, the archery draw stop system 310 is configured to be mounted to the limb portion 312 of the limb 20. In an embodiment, the archery draw stop system 310 includes: (a) a support or base 314 that is attachable to the limb portion 312; (b) a draw stopper 316 that is moveably and adjustably coupled to the base 314; (c) a limb coupler 317 configured to attach or couple the base 314 to the limb portion 312; and (d) a plurality of stopper couplers 318 configured to attach or couple the draw stopper 316 to the base 314.

Figure 20A:
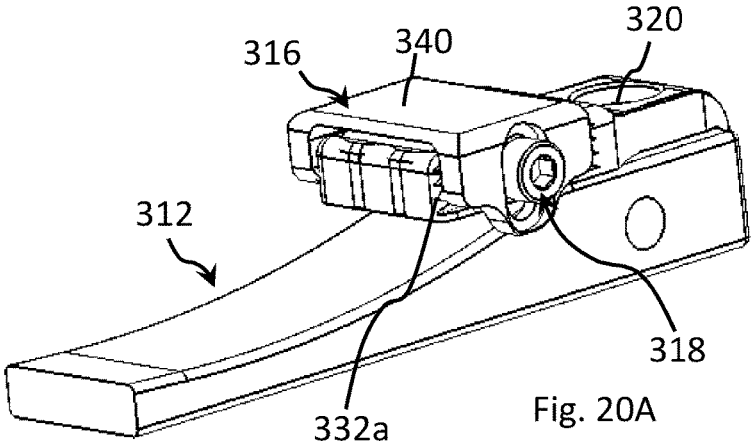
FIG. 20A is an enlarged, isometric view of the archery draw stop system of FIG. 18, illustrating the draw stopper in a first position relative to the limb portion.
Figure 20B:
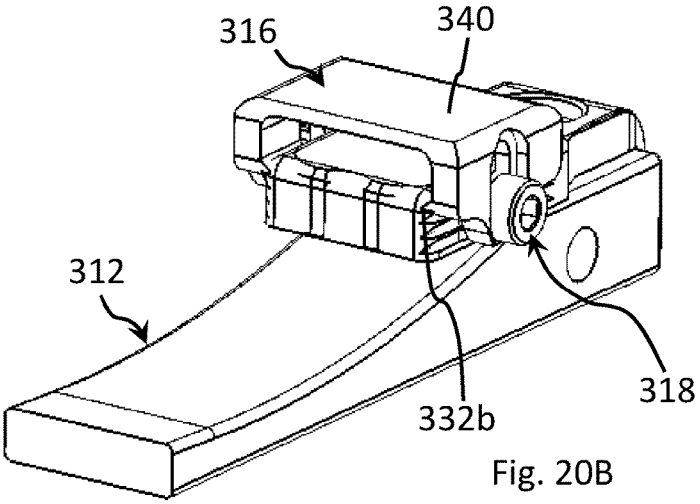
FIG. 20B is an enlarged, isometric view of the archery draw stop system of FIG. 18, illustrating the draw stopper in a second position relative to the limb portion.
Figure 20C:
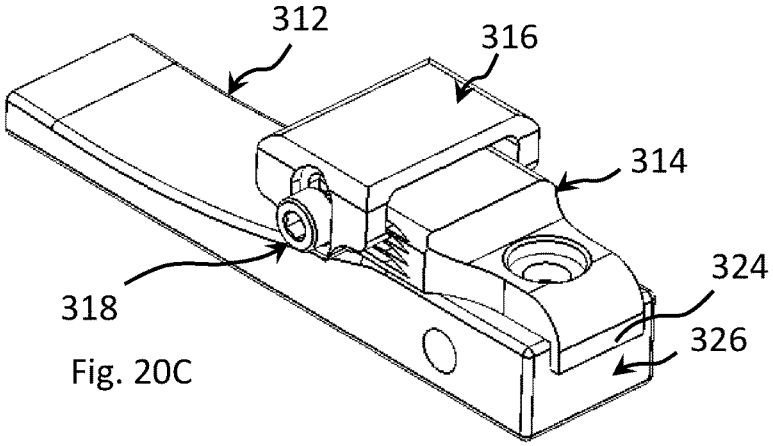
FIG. 20C is an enlarged, rear isometric view of the archery draw stop system of FIG. 18, illustrating the stabilizer engaged with the end wall of the limb portion.

In an embodiment, the base 314 defines a pilot hole or opening 320 configured to receive the limb coupler 317. Though the limb coupler 317 is illustrated as a threaded screw, it should be appreciated that the limb coupler 317 can include any suitable, screw, bolt, pin or other suitable fastener. A user can attach the base 314 to the limb portion 312 by placing the base 314 on the limb portion 312 and then inserting the limb coupler 318 through the opening 320 and into the threaded hole or opening 322 of the limb portion 312. After rotating the limb coupler 317, the base 314 will be mounted to the limb portion 312. As illustrated in FIG. 20C, in an embodiment, the base 314 has a hook portion or stabilizer 324 that extends to engage the end wall 226 of the limb portion 212. As described in other embodiments above, the stabilizer 324 enhances the securement and stationary seating of the base 314 on the limb portion 312.

Figure 21A:
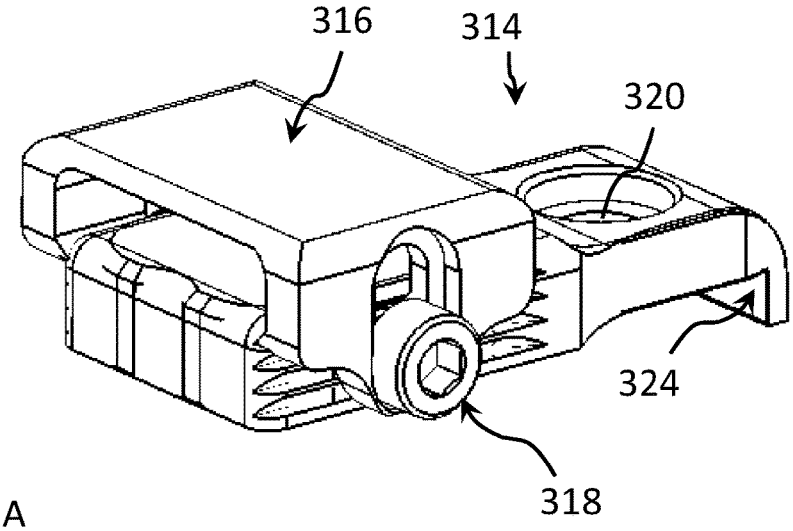
FIG. 21A is an enlarged, isometric view of the archery draw stop system of FIG. 18.
Figure 21B:
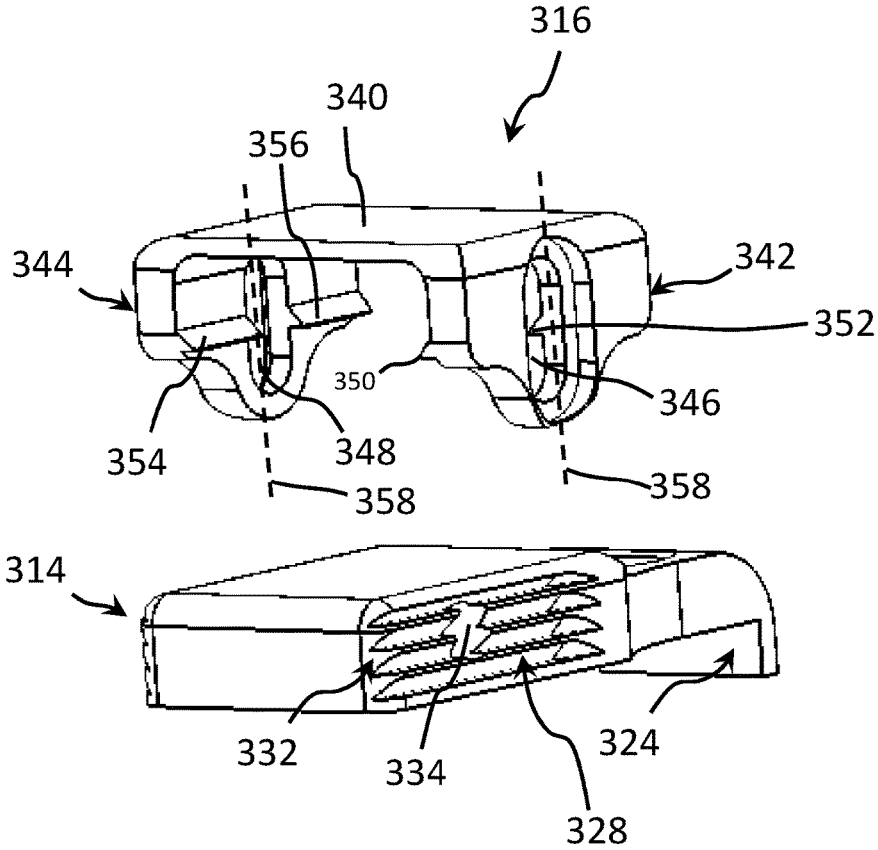
FIG. 21B is an enlarged, isometric view of the archery draw stop system of FIG. 18, illustrating the draw stopper detached from the base.
Figure 22A:
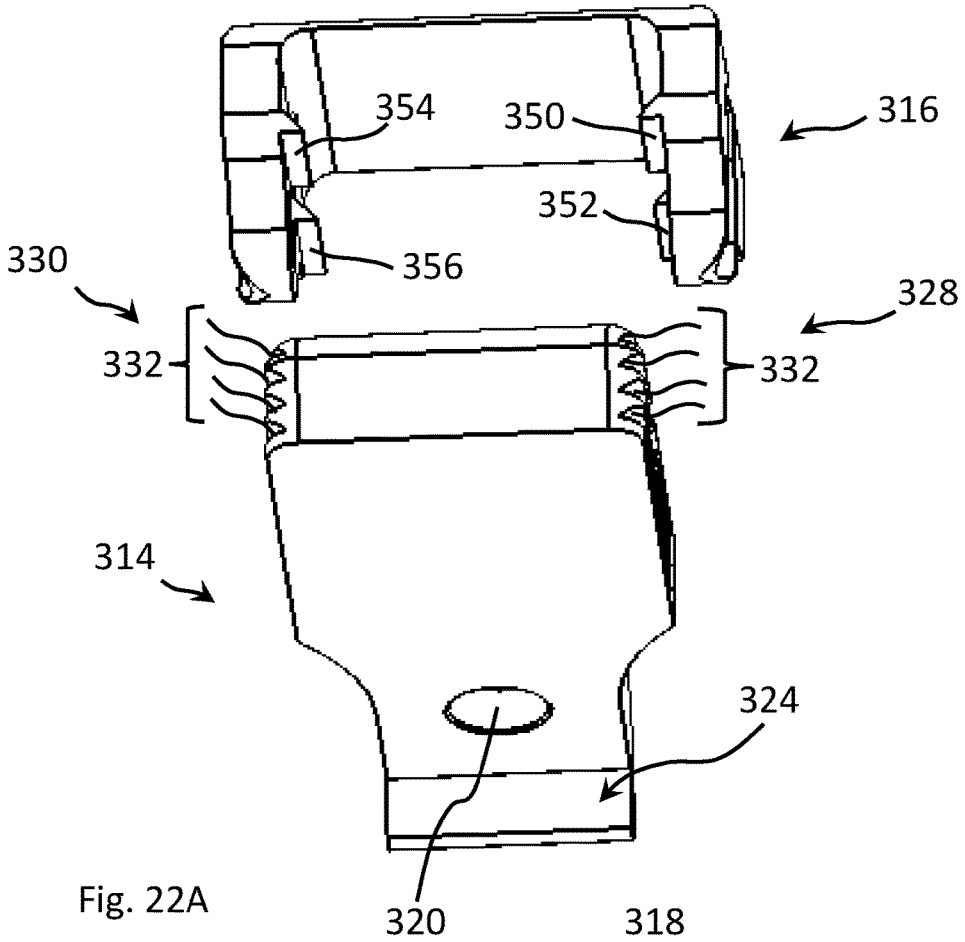
FIG. 22A is an enlarged, bottom isometric view of the archery draw stop system of FIG. 18, illustrating the draw stopper detached from the base.

In addition, as illustrated in FIG. 22A, the base 314 includes a plurality of base sides 328, 330, each of which defines a plurality of channels, grooves or slots 332. The base side 328 defines a threaded hole or threaded opening 334 (FIG. 21B), and the base side 330 defines a threaded hole or threaded opening 338 (FIG. 22B).

Figure 22B:
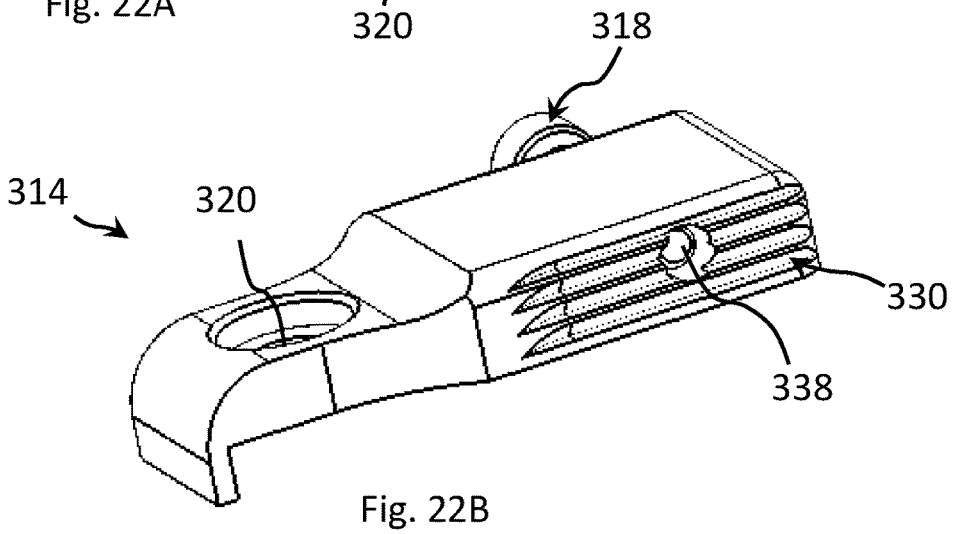
FIG. 22B is an enlarged, side isometric view of the archery draw stop system of FIG. 18.

Referring to FIGS. 21B and 22B, the draw stopper 316 includes a stopper surface 340 configured to physically contact the rotary 24, a portion thereof or the draw stop member 80. As described above, the interference between the stopper surface 340 and the rotary 24, a portion thereof or the draw stop member 80 causes the rotary 24 to stop from rotating relative to the bow 2. The stoppage determines the draw length of the bow 2. Also, the draw stopper 316 includes: (a) an adjustment interface 342 configured to slideably interface with the base side 332; and (b) an adjustment interface 344 configured to slideably interface with the base side 330. The adjustment interfaces 342 and 344 define a plurality of elongated adjustment openings 346 and 348, respectively. The adjustment interface 342 defines or includes a plurality of inserts or linear protrusions 350, 352 positioned on opposite sides of the adjustment opening 346. Likewise, the adjustment interface 344 defines or includes a plurality of inserts or linear protrusions 354, 356 positioned on opposite sides of the adjustment opening 348. Each of the adjustment openings 346, 348 has a first diameter and a second diameter that is larger than the first diameter. For example, the second diameters extending along the longitudinal axes 358.

In an embodiment, each of the slots 332 is associated with a different draw stop setting for the rotary 24. For example, as illustrated in FIG. 20A, slot 332*a* is associated with a draw stoppage of magnitude X. As illustrated in FIG. 20B, slot 332*b* is associated with a draw stoppage of magnitude Y. In this example, magnitude Y is greater than magnitude X. As shown, the stopper surface 340 as positioned in FIG. 20B is higher, relative to the limb portion 312, than the stopper surface 340 as positioned in FIG. 20A.

A user can attach the draw stopper 316 to the base 314 by first selecting a desirable one of the slots 332. Next, the user slides the draw stopper 316 onto the base 314 by inserting the linear protrusions 350, 352 into the selected slot 332 on the base side 328 and by inserting the linear protrusions 354, 356 into the selected slot 332 on the base side 330. Next, the user inserts one of the stopper couplers 318 through the adjustment opening 346 and into the threaded opening 334 (FIG. 21B). Also, the user inserts the other stopper coupler 318 through the adjustment opening 348 and into the threaded opening 338 (FIG. 22B). The user then screws the stopper coupler 318, which causes the adjustment interfaces 342, 344 to flex toward each to sandwich the base 314. In particular, the adjustment interfaces 342, 344 flex or move toward the base 314, generating a compression force on the base 314. This secures the draw stopper 316 to a fixed position relative to the base 314. Though each stopper couplers 318 is illustrated as a threaded screw, it should be appreciated that each stopper coupler 318 can include any suitable, screw, bolt, pin or other suitable fastener.

If, for example, the user desires to change the draw stop setting from the relatively high setting shown in FIG. 20B to the lower setting shown in FIG. 20A, the user can unscrew and remove the stopper couplers 318. Next, the user can slide the draw stopper 316 off of the base 314 and slide the draw stopper 316 back onto the base 314, using the slots 332*a*. Then, the user can insert and tighten the stopper couplers 318. This provides users with an improvement in convenience, ease of use and the degree of micro-control over the draw stop setting of the bow 2.

As described above, there are several advantages of the limb-mounted archery draw stop systems 44, 112, 210, 310 and the duel draw stop system described above, including, but not limited to: (a) providing the user with enhanced control over the micro-level adjustment of the draw stop setting of the bow 2; (b) easing the process for adjusting the draw stop setting; (c) protecting the limb surface 166 from direct contact with rotaries 22, 24, draw stop members 80 and rotary members; and (d) changing (e.g., decreasing by 10%) the force let-off during the drawback of the draw cord 36. Such systems also lessen design constraints on rotary and module designs. Such easing of design constraints results in a more cost effective approach for stopping the draw. In addition, such systems provide enhanced stability and ease of use, in part, because they are supported by bow limbs instead of or in addition to rotaries. Depending upon the embodiment, such systems can also reduce weight-related problems and off-center loading problems associated with complete reliance on rotary-based draw stops. Further, such systems can more readily accommodate various limb configurations than a typical rotary-mounted draw stop and enable the users to have greater control over fine-tuning and micro adjustments of the draw stop setting, as described above.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery draw stop system comprising:

a body comprising:

a limb engager configured to be mounted to a limb portion of a limb of an archery bow, wherein the limb engager defines an opening, wherein the limb portion extends along an axis, and the limb portion comprises an end wall;

a draw stopper portion configured to contact a member that is coupled to a rotary of the archery bow, wherein the rotary is coupled to the limb; and a stabilizer configured to engage the end wall of the limb portion to inhibit movement of the limb engager relative to the axis; and a limb coupler configured to be inserted through the opening to couple the limb engager to the limb.

2. The archery draw stop system of claim 1, wherein the member is integral with the rotary.

3. The archery draw stop system of claim 1, wherein the member comprises a stop member that is adjustably coupled to the rotary.

4. The archery draw stop system of claim 1, wherein the body extends along a body axis that is parallel to the axis.

5. The archery draw stop system of claim 1, wherein the draw stopper portion defines a cavity.

6. The archery draw stop system of claim 1, wherein:

the limb engager comprises an end; and the stabilizer extends from the end.

7. The archery draw stop system of claim 6, wherein:

the body extends along a body axis that is parallel to the axis;

the body axis extends in a first plane; and the stabilizer extends in a second plane that intersects with the first plane.

8. The archery draw stop system of claim 6, wherein the draw stopper portion comprises a dimension associated with a draw length.

9. The archery draw stop system of claim 1, wherein the draw stopper portion defines a cavity configured to at least partially receive a contact member, wherein the contact member comprises a draw stopper surface.

10. The archery draw stop system of claim 9, comprising a driver that is operatively coupled to the contact member, wherein the driver is configured to cause the contact member to move relative to the body in response to an adjustment of the driver.

11. An archery draw stop system comprising:

a limb engager configured to be mounted to a limb portion of a limb of an archery bow, wherein the limb portion defines an opening;

a draw stopper portion configured to engage a member that is coupled to a rotary of the archery bow, wherein the rotary is coupled to the limb and configured to support a draw cord;

a limb coupler configured to be inserted through the opening to couple the limb engager to the limb portion; and a stabilizer configured to engage an end of the limb portion.

12. A kit comprising: (a) a first device comprising the archery draw stop system of claim 11, wherein the first device comprises a first size associated with a first draw stop setting; and (b) a second device comprising the archery draw stop system of claim 11, wherein the second device comprises a second size associated with a second draw stop setting, wherein the first and second draw stop settings differ.

13. The archery draw stop system of claim 11, wherein:

the limb portion extends along an axis;

the end of the limb portion comprises an end wall; and the stabilizer is configured to engage the end wall of the limb portion to inhibit movement of the limb engager relative to the axis.

14. The archery draw stop system of claim 11, wherein the member is integral with the rotary.

15. The archery draw stop system of claim 11, wherein the member comprises a stop member that is adjustably coupled to the rotary.

16. The archery draw stop system of claim 11, wherein:

the draw stopper portion and the limb portion each extend along a common axis; and the limb engager, the draw stopper portion and the stabilizer are integral regions of a one piece element.

17. A method for manufacturing an archery draw stop system, the method comprising:

structuring a limb engager so that the limb engager is configured to be mounted to a limb portion of a limb of an archery bow;

structuring a draw stopper portion so that the draw stopper portion is configured to engage a member that is coupled to a rotary of the archery bow, wherein the rotary is coupled to the limb and configured to support a draw cord, wherein: (a) the limb portion extends along an axis; and (b) the limb portion comprises an end wall; and structuring a stabilizer so that the stabilizer is configured to engage the end wall of the limb portion to inhibit movement of the limb engager relative to the axis.

18. A method for manufacturing a kit, the method comprising: (a) structuring a first device so that the first device comprises the archery draw stop system resulting from the method of claim 17, wherein the first device comprises a first size associated with a first draw stop setting; and (b) structuring a second device so that the second device comprises the archery draw stop system resulting from the method of claim 17, wherein the second device comprises a second size associated with a second draw stop setting, wherein the first and second draw stop settings differ.

19. The method of claim 17, wherein:

the limb portion defines an opening;

the limb engager, the draw stopper portion and the stabilizer are integral regions of a one piece element; and the method comprises structuring a limb coupler so that the limb coupler is configured to be inserted through the opening to couple the limb engager to the limb portion.

20. The method of claim 17, wherein:

the axis comprises a limb axis;

the draw stopper portion extends along the limb axis;

the limb axis extends in a first plane; and the method comprises structuring the stabilizer so that the stabilizer extends in a second plane that intersects with the first plane.

* * * * *